US011097860B2

(12) United States Patent
Lorenzen et al.

(10) Patent No.: US 11,097,860 B2
(45) Date of Patent: Aug. 24, 2021

(54) PACKAGING METHOD AND STRETCH HOOD SYSTEM

(71) Applicant: Signode Industrial Group LLC, Glenview, IL (US)

(72) Inventors: Gynter Lorenzen, Sydals (DK); Tonny Konstmann, Nordborg (DK)

(73) Assignee: Signode Industrial Group LLC, Glenview, IL (US)

( * ) Notice: Subject to any disclaimer, the term of this patent is extended or adjusted under 35 U.S.C. 154(b) by 198 days.

(21) Appl. No.: 16/098,343

(22) PCT Filed: Jul. 6, 2017

(86) PCT No.: PCT/US2017/040854

§ 371 (c)(1),
(2) Date: Nov. 1, 2018

(87) PCT Pub. No.: WO2018/009629

PCT Pub. Date: Jan. 11, 2018

(65) Prior Publication Data

US 2019/0152632 A1 May 23, 2019

(30) Foreign Application Priority Data

Jul. 7, 2016 (DE) ..... 10 2016 212 436.6

(51) Int. Cl.
*B65B 9/13* (2006.01)
*B65B 9/14* (2006.01)
*B65B 13/32* (2006.01)

(52) U.S. Cl.
CPC ..... *B65B 9/135* (2013.01); *B65B 9/14* (2013.01); *B65B 13/32* (2013.01)

(58) Field of Classification Search
CPC ..... B65B 9/14; B65B 9/135; B65B 9/175; B65B 9/551; B65B 9/218; B65B 13/32
(Continued)

(56) References Cited

U.S. PATENT DOCUMENTS 3,621,638 A * 11/1971 Grocke ..... B65B 9/135 53/386.1
3,676,980 A * 7/1972 Engelhardt ..... B65B 9/135 53/567
(Continued)

FOREIGN PATENT DOCUMENTS

CN 2820706 Y 9/2006
CN 101331061 B 6/2010
(Continued)

OTHER PUBLICATIONS

Machine translation of Office Action Issued by CIPO in connection with CN20178002868.4, dated Mar. 23, 2020.
(Continued)

*Primary Examiner* — Dariush Seif
(74) *Attorney, Agent, or Firm* — Neal, Gerber & Eisenberg LLP

(57) ABSTRACT

Packaging method and device in which, with the aid of a stretch hood system 1, a tubular film portion 3 is drawn over an article 2 that is to be packaged. The tubular film portion 3 is firstly reefed with the aid of a reefing device 8 onto at least two reefing fingers 7 of a drawing-over device 6. Then, by moving the drawing-over device 6 along the article 2 that is to be packaged, the tubular film portion 3 is unreefed from the reefing fingers 7 of the drawing-over device 6 and drawn at least in sections over the article 2. During the reefing, the tubular film portion 3 is at least intermittently inflated.

13 Claims, 16 Drawing Sheets

(58) Field of Classification Search
USPC ..... 53/441, 577
See application file for complete search history.

(56) References Cited

U.S. PATENT DOCUMENTS

| | | | | | |
|---|---|---|---|---|---|
| 3,707,064 | A * | 12/1972 | Mucka | B65B 9/135 | 53/567 |
| 3,735,557 | A * | 5/1973 | Hoffarth | B65B 9/135 | 53/567 |
| 3,852,937 | A * | 12/1974 | Bitsura | B65B 9/135 | 53/442 |
| 3,897,674 | A * | 8/1975 | Higgins | B65B 9/135 | 53/66 |
| 3,902,303 | A * | 9/1975 | King | B65B 9/135 | 53/556 |
| 3,925,964 | A * | 12/1975 | Birkenfeld | B65B 9/135 | 53/567 |
| 3,944,045 | A * | 3/1976 | Higgins | B65B 9/135 | 198/340 |
| 4,050,219 | A * | 9/1977 | Higgins | B65B 9/135 | 53/567 |
| 4,063,401 | A * | 12/1977 | Higgins | B65B 9/135 | 53/567 |
| 4,064,678 | A * | 12/1977 | Grocke | B65B 9/135 | 53/567 |
| 4,724,658 | A * | 2/1988 | Birkenfeld | B65B 53/063 | 53/557 |
| 4,991,633 | A * | 2/1991 | Wong | B65B 31/00 | 141/10 |
| 5,247,783 | A * | 9/1993 | Hannen | B65B 9/135 | 53/556 |
| 5,502,947 | A * | 4/1996 | Birkenfeld | B65B 53/066 | 53/442 |
| 6,032,439 | A * | 3/2000 | Birkenfeld | B65B 9/135 | 53/441 |
| 6,161,365 | A * | 12/2000 | Girard | B65B 25/02 | 53/441 |
| 6,298,636 | B1 * | 10/2001 | Lachenmeier | B65B 9/135 | 53/442 |
| 6,421,983 | B1 * | 7/2002 | Lachenmeier | B65B 53/066 | 53/442 |
| 6,470,654 | B1 * | 10/2002 | Lachenmeier | B65B 9/135 | 53/459 |
| 7,040,076 | B2 * | 5/2006 | Lachenmeier | B65B 9/135 | 53/441 |
| 7,234,289 | B2 * | 6/2007 | Hannen | B65B 9/15 | 53/441 |
| 7,703,263 | B2 * | 4/2010 | Reiner | B65B 53/066 | 53/442 |
| 7,913,476 | B2 * | 3/2011 | Lachenmeier | B65B 59/04 | 53/441 |
| 7,966,790 | B2 * | 6/2011 | Michels | B65B 9/135 | 53/556 |
| 8,875,480 | B2 * | 11/2014 | Czok | B65B 9/135 | 53/474 |
| 9,764,867 | B2 * | 9/2017 | Lachenmeier | B65B 9/13 | |
| 10,273,031 | B2 * | 4/2019 | Fenn | B65B 65/02 | |
| 10,421,570 | B2 | 9/2019 | Kristensen et al. | | |
| 10,526,097 | B2 * | 1/2020 | Lachenmeier | B65B 9/135 | |
| 2002/0033005 | A1 * | 3/2002 | Lachenmeier | B65B 9/135 | 53/459 |
| 2002/0170270 | A1 * | 11/2002 | Borchard | B65B 9/135 | 53/432 |
| 2004/0107677 | A1 * | 6/2004 | Hannen | B65B 9/135 | 53/459 |
| 2004/0182050 | A1 * | 9/2004 | Pieri | B65B 11/045 | 53/556 |
| 2005/0229544 | A1 * | 10/2005 | Casadei | B65B 11/025 | 53/399 |
| 2006/0196578 | A1 * | 9/2006 | Nyhof | B65B 43/54 | 141/314 |
| 2008/0134640 | A1 * | 6/2008 | Bowden | B65B 11/025 | 53/432 |
| 2008/0216450 | A1 * | 9/2008 | MacLeod | B65B 9/135 | 53/432 |
| 2009/0211205 | A1 * | 8/2009 | Lachenmaier | B65B 9/135 | 53/461 |
| 2010/0071317 | A1 * | 3/2010 | Michels | B65B 9/135 | 53/441 |
| 2011/0258973 | A1 * | 10/2011 | Czok | B65B 9/135 | 53/473 |
| 2013/0180214 | A1 * | 7/2013 | Lachenmeier | B65B 11/00 | 53/461 |
| 2013/0205717 | A1 * | 8/2013 | Bowden | A23L 3/3418 | 53/403 |
| 2014/0013714 | A1 * | 1/2014 | Lachenmeier | B65B 9/13 | 53/459 |
| 2014/0102046 | A1 * | 4/2014 | Tellen | B65B 9/14 | 53/461 |
| 2014/0137516 | A1 * | 5/2014 | Lachenmeier | B65B 9/135 | 53/441 |
| 2014/0157724 | A1 * | 6/2014 | Hannen | B65B 11/585 | 53/442 |
| 2016/0221703 | A1 * | 8/2016 | Fenn | B65B 59/04 | |
| 2017/0073092 | A1 * | 3/2017 | Bocedi | B65B 9/135 | |
| 2018/0044043 | A1 * | 2/2018 | Frenzel | B65B 35/405 | |

FOREIGN PATENT DOCUMENTS

| | | | |
|---|---|---|---|
| DE | 3116194 | A1 | 11/1982 |
| DE | 4327450 | C1 | 1/1995 |
| DE | 198 19 488 | A1 | 11/1999 |
| EP | 0460682 | A | 12/1991 |
| EP | 0764579 | A1 | 3/1997 |
| EP | 0933297 | A1 | 8/1999 |
| KR | 10-2008-0078003 | A | 8/2008 |
| KR | 10-1355820 | B1 | 1/2014 |

OTHER PUBLICATIONS

"Notice of Reasons for Rejection", Corresponding Japanese Application No. JP2018-560560 (5 pages), dated Oct. 11, 2019.

Machine translation of Office Action issued by KIPO in connection with KR Patent Application No. 10-2018-7031923 and dated Mar. 20, 2020.

European Patent Office acting as International Searching Authority, International Search Report and Written Opinion in corresponding application No. PCT/US2017/040854, dated Sep. 29, 2017 (9 pages).

"Communication Pursuant to Article 94(3) EPC", Corresponding European Patent Application No. EP 17 739 835.1 (4 pages), dated Mar. 12, 2020.

* cited by examiner

PACKAGING METHOD AND STRETCH HOOD SYSTEM

PRIORITY CLAIM

This application is a national stage application of PCT/US2017/040854, filed on Jul. 6, 2017, which claims priority to and the benefit of German Patent Application No. 10 2016 212 436.6, filed on Jul. 7, 2016, the entire contents of which are incorporated by reference herein.

FIELD

The present disclosure relates to a packaging method in which, with the aid of a stretch hood system, a tubular film portion is drawn over an article that is to be packaged. The present disclosure further relates to a stretch hood system with a reefing device for reefing a tubular film portion onto a drawing-over device that has at least two reefing fingers.

BACKGROUND

Various packaging methods and stretch hood systems are known in principle, for example from the German patent DE 102010037770 B4. With the aid of a stretch hood system, any desired article can be at least partially wrapped with a tubular film.

In the packaging method of the type in question, sometimes also referred to as a stretch hood method, a tubular film portion is firstly opened with the aid of a tube-opening device and is then reefed with a reefing device onto at least two reefing fingers of a drawing-over device. These reefing fingers serve for the intermediate storage of the received film until the latter is processed in the subsequent method steps. They are therefore generally L-shaped. The film reservoir received on the fingers is also extended with the aid of the drawing-over device by moving the reefing fingers away from each other.

Then, by moving the drawing-over device along the article that is to be packaged, the tubular film portion is unreefed from the reefing fingers of the drawing-over device and drawn at least in sections over the article. Particularly if the film portion has been extended beforehand, it can then conform to the article, on account of the stress relief that takes place during unreefing, and can hold this article for example on a support such as a pallet.

Within the meaning of this application, however, a package is not to be understood only in the sense of packages that are formed as a hood, but also packages that are at least partially open at the top, for example like banderole packages.

The tubular film used is normally a folded film tube wound onto a reel. This film tube is usually unrolled in the stretch hood system during the packaging method and cut to a desired length, before or while being opened and reefed. Depending on whether the package to be produced is a hood-shaped or banderole-shaped package, the portion is welded or left open at the rear end. However, within the meaning of the present disclosure, it is also conceivable to use prefabricated tubular film portions, in particular tubular film portions that are cut to length and/or welded.

As has been stated, the reefing device serves to reef the tubular film portion onto the reefing fingers of the drawing-over device. Reefing is to be understood herein as a gathering of tubular film on the drawing-over device. Since the tubular film portion is normally deliberately folded during reefing, the tubular film portion can have a greater length than the reefing fingers are high. To permit reefing at all, the reefing device has at least one mechanism for moving the tubular film portion along the reefing fingers. This mechanism is usually configured as a roller or conveyor belt. Moreover, the reefing device is generally controllable and displaceable separately from the drawing-over device, such that it can be moved independently of the drawing-over device and in particular brought up to the reefing fingers.

To ensure that the reefing device or the reefing fingers can in fact be inserted into the tubular film portion, the latter has to be opened beforehand by way of a tube-opening device. The latter therefore has mechanisms such as clamps and/or suction boxes for gripping and opening the tube.

The drawing-over device is configured such that it can draw the tubular film portion over the article to be treated. Generally, it is therefore configured as a device that is vertically movable along a machine frame.

In recent years, the packaging methods of the type in question have seen a trend toward ever thinner tubular films. The aim of this is to reduce the costs of the packaging. While a film thickness of less than 60 micrometers was still a rarity 10 years ago, in the meantime film thicknesses of just 20 micrometers are in use. However, tubular film portions with a film thickness of less than 40 micrometers are particularly sensitive. When such thin tubular films are used, it is found time and time again that they start to tear particularly easily during the packaging procedure or are otherwise damaged.

This problem is at present solved by carrying out the packaging method more slowly. However, this has an impact on the economics of the method and of the packaging system.

SUMMARY

It is therefore an object of the present disclosure to improve the packaging method of the type in question and the packaging device of the type in question such that the tubular films used can be processed more efficiently than hitherto.

In various embodiments, the object is solved by the method as described herein and according to claim 1 and by the device as described herein and according to claim 12. Advantageous developments of the prevent disclosure are also set forth in the dependent claims.

The packaging method according to various embodiments of the prevent disclosure is thus characterized in that, during the opening and/or during the reefing, the tubular film portion is at least intermittently inflated. By virtue of this step, it is possible to stabilize the temporary shape of the tubular film portion. Thus, the tubular film portion can already be stabilized during the opening procedure but also during the drawing-over procedure. This accelerates the approach movement of the reefing device and improves the opening process.

It is also thereby possible to reef the tubular film portion more uniformly than hitherto. The inflation of the tubular film portion during the reefing means that the tubular film portion is smoothed before being brought onto the reefing fingers. The tubular film portion located on the reefing fingers after this method step thus contains fewer undesired folds, in particular folds extending transversely with respect to the main direction of folding, which folds could lead to problems in the subsequent unreefing of the tubular film portion. Specifically if folds are deliberately generated during reefing, the inflation increases the precision of any fold formation during reefing. The resulting greater precision of the fold formation during reefing then enables the tubular film portion to be unreefed more quickly, and also subjected to a greater load, than has hitherto been possible.

It is also possible to dispense with an occasionally used speed difference between the reefing drive and a possible feed drive. During reefing, the tubular film portion is then no longer pulled or extended so strongly in the longitudinal direction. Moreover, by reducing the tensile stress, it is possible to avoid the impressions that the reefing fingers sometimes make in the tubular film. This greatly protects the material of the tubular film portion during reefing and leads to appreciably less damage to the film.

For all of these reasons, the packaging method according to the present disclosure is much more efficient. Although the method is particularly advantageous specifically for thin films, corresponding advantages are also afforded in the case of thicker films.

In various embodiments of the present disclosure, during the opening of the tubular film portion, the tubular film portion is expediently inflated such that the tubular film portion is extended at least in the area of its open edge. In stretch hood systems operating in the vertical direction, this is generally the lower edge of the tubular film portion. The extension of the open edge by the inflation ensures that the edge is stabilized when the reefing fingers of the drawing-over device are inserted into the tube and do not yet bear thereon. Thus, the tube-opening device is already able to release the tube more quickly than hitherto. Moreover, it is possible, without any problems, to use tube-opening devices that have recesses for the passage of at least one reefing finger.

In a development, the tubular film portion is also inflated at least intermittently during the unreefing. In this way, the temporary shape of the tubular film portion sliding from the reefing finger is smoothed and stabilized before bearing on the article. This further reduces the punctifom loading of the tubular film and reduces the number of films that fail, such that the packaging method overall can be performed more quickly.

It is moreover advantageous if the tubular film portion is inflated at least intermittently during and/or after a welding of the tubular film portion. In this way, the weld seam can already be cooled during the welding, and, beyond the welding process, cooling can also be achieved by the inflation. The method step involving welding can also be completed more quickly and, in this way, the packaging method overall can be expedited. A further advantage is that the tubular film portion is drawn smooth during the welding, resulting in an even smoother and more durable weld seam in the tubular film portion.

While it is being inflated, the tubular film portion is expediently held at least intermittently by a tube-opening device. The tube-opening device can be configured in any desired form. It simply has to be able to hold and open the tubular film portion that is initially folded flat. It can thus have a plurality of opposite suction boxes to hold the tubular film portion by way of underpressure and then draw it apart. It is recommended that this device for holding the tubular film portion, which is present in most cases anyway, also be used to hold the tubular film portion during the inflation. Moreover, it is possible that holding devices additionally mounted on the tube-opening device additionally secure the tubular film portion.

Advantageously, in various embodiments of the present disclosure, the tubular film portion is held at its open end by the tube-opening device during insertion of the reefing fingers and is at least intermittently inflated. The tubular film portion is thus already inflated during the insertion of the reefing fingers. In this way, the insertion of the reefing fingers into the tubular film portion is made considerably easier, and the risk of the film being damaged by the reefing fingers is greatly reduced. A further advantage is that the reefing fingers can be inserted farther into the tubular film portion, and the tubular film portion can then be brought into contact with the reefing fingers in a manner free of folds. This results in a more uniform feed of the tubular film portion to the corresponding reefing fingers.

Alternatively, during the insertion of the reefing fingers, the tubular film portion is held only by a pressing force, generated by inflation, pressing the tubular film portion onto the tube-opening device. The inflation of the tubular film portion results in an overpressure forming inside the tubular film portion, which forces the tubular film radially outward and presses it against the surrounding tube-opening device. The tubular film portion can thus be held in the tube-opening device entirely without clamping.

Advantageously, after opening the tubular film portion, the tube-opening device holds the latter such that at least one cross-section side of the tubular film portion is not made taut or extended. A cross-section side is understood as a portion of the tubular film portion between two holding points at the tube-opening device, for example between two suction boxes. By way of a cross-section side deliberately being held loose, more material of the tubular film is available in this area to achieve a lateral bulging of the tubular film portion through the inflation. The bulge does not need to have a round profile. For example, the cross section of the tubular film portion can be provided as a rectangle. Thus, a polygonal bulge could form upon deployment of the cross section through the inflation. This is the case when at least one corner of the cross section is located on a loosely held cross-section side. However, a stable shape of the tubular film portion is achieved since the cross section of the tubular film portion is completely deployed through the inflation. This has the advantage that the reefing fingers can be inserted, offset from the tube-opening device, into the tubular film portion. The area between reefing finger and reefing device is therefore not blocked by the tube-opening device. More space is created to move the reefing device earlier to the reefing fingers. Moreover, damage to the tubular film portion by tautening and extension by the tube-opening device is avoided. For example, the tube-opening device could hold the tubular film portion taut only on two opposite sides, while the two front faces remain loose.

Preferably, in certain embodiments, the tubular film portion is at least intermittently inflated such that the tubular film is extended. The width of the opening of the tubular film portion is increased by the extension. Folds are also smoothed out. Upon insertion of the reefing fingers into the tubular film portion, a wider opening reduces the risk of the reefing fingers damaging the tubular film portion. Moreover, the reefing fingers can be inserted into the tubular film portion with a greater distance from the tube-opening device than hitherto. A further advantage is the generation of an air cushion between the tubular film portion and the reefing fingers as soon as these could come into contact in the corresponding method steps. The friction between the tubular film portion and the reefing fingers is thereby reduced still further. This has the effect that the tubular film portion can be reefed and unreefed with even less material stress.

The tubular film portion is expediently inflated by blowing air and/or a special gas into the tubular film portion. In this connection, the gas can contain liquid or solid elements. This is particularly useful when the article or the tubular film is to be coated with a corresponding medium for example.

It is equally conceivable that a gas for preserving the article is blown into the tubular film portion. It is moreover possible to use warm air when inflating the tubular film portion. In this way, the material properties of the tubular film portion can be modified. Warm air is understood in the sense of all temperature values above the local ambient temperature.

It is moreover advantageous if the tubular film portion is inflated depending on at least one property of the tubular film, for example its film thickness. The property of the tubular film can be understood as any kind of material characteristic such as film thickness, tear strength and extensibility. The variable inflation has the advantage that, if different tubular films are used, the method can be optimized specifically to the respective type of film used.

The object is achieved, in terms of the device, by a stretch hood system according to claim 12, that is to say a stretch hood system with a tube-opening device for opening a folded tubular film portion and with a reefing device for reefing the tubular film portion onto a drawing-over device that has at least two reefing fingers, wherein the stretch hood system additionally has at least one inflating device, which is arranged and designed such that the tubular film portion can be at least intermittently inflated by it during opening, reefing and/or unreefing. The advantages already outlined above in relation to the method can also be achieved in this way. Reefing can thus be carried out more quickly while also providing an improved reefing and unreefing quality. Overall, a still better packaging quality is obtained, and thinner films can be processed overall.

An inflating device can be understood as any device that is able to generate a flow of air in the direction of the interior of the tubular film portion. This can be a fan or also a source of compressed air. The inflating device can also be arranged at any desired location of the stretch hood system. In certain embodiment, it is important only that it is able to divert a flow of air in the direction of the interior of the tubular film portion.

In a development, the tube-opening device is configured such that it at least partially encloses at least one reefing finger and preferably has at least one suction box with a recess for passing a reefing finger through the tube-opening device. Thus, the reefing finger can already be inserted into the tubular film portion while the tube-opening device is still holding the tubular film portion. Moreover, as a result of the inflation during the opening procedure, it is even conceivable that the tubular-film-opening device can change seamlessly to holding the tubular film portion by the reefing fingers. This is because the tube, in the best case, can be sufficiently stabilized by the inflation at least for a short time.

The at least one inflating device is expediently arranged at least partially inside a reefing finger. In this way, the inflating device can be positioned very close to the lower opening of the tubular film portion, which makes the inflation easier. The inflating device can thus inflate the tubular film portion still more precisely. It can do this even when the reefing fingers change their position relative to the tubular film portion, since the position of the inflating device changes accordingly. By way of several inflating devices in the different reefing fingers, the tubular film portion can also be inflated even more uniformly and more reliably.

It may also be expedient that the at least one inflating device is arranged at least partially at the tube-opening device. When opening the tube, it can thus already be used to stabilize the latter in a very targeted manner.

The stretch hood system preferably has an adjusting device for adjusting the delivery properties (for example the speed, the volumetric flow, the total amount of air delivered, etc.) of the at least one inflating device. Thus, during the inflation of the tubular film portion, account can be taken of the material nature and resistance of the tubular film of the tubular film portion. Moreover, in the case of a relatively thin film, a smaller amount of air or gas volume can be delivered to the tubular film portion. However, if the tubular film portion has a particularly durable material, or if the thickness of the tubular film is in the normal to thicker range, the tubular film portion can be inflated more strongly.

The adjusting device expediently has a throttle element for adjusting the power of the at least one inflating device. The throttle element can, for example, be a valve and/or a flap with which the emerging quantity of air or gas of the inflating device can be adjusted. It is preferably possible to control the valve and/or the flap electronically or mechanically via the adjusting device.

It is advantageous if at least one reefing finger of the stretch hood system has at least one outlet opening that can be selectively closed by a closure element, for example a flap. In this connection, it is possible that a reefing finger also has several outlet openings, which are all part of the inflating device. A flap is expediently arranged at the outlet opening in order, by selective closure, to regulate the generated volumetric flow of air or gas and also to lead it in the direction of the interior of the tubular film portion.

The at least one outlet opening is advantageously arranged on a side of the reefing finger opposite a reefing-on surface. By way of this arrangement, it is possible that the stream of air or gas generated by the inflating device can be conveyed through the reefing finger into the interior of the tubular film portion. This has the advantage that a suitably stabilizing stream of air or gas is generated precisely at the locations where the tubular film portion could be damaged.

The at least one inflating device expediently has a pressure-increasing mechanism. For example, this can be a compressor or the like. A pressure-increasing mechanism can supply several inflating devices and each individual inflating device can contain a separate pressure-increasing device.

BRIEF DESCRIPTION OF THE DRAWINGS

The subject matter of the invention is explained in more detail below on the basis of different illustrative embodiments and with reference to the schematic drawings, in which:

FIG. 1 shows a perspective overall view of a stretch hood system 1 of the type in question known from the prior art, with which a tubular film portion 3 can be drawn over an article 2. In order to better illustrate the main sequences, not all components are explicitly shown.

DETAILED DESCRIPTION OF THE DRAWINGS

Figure 1:
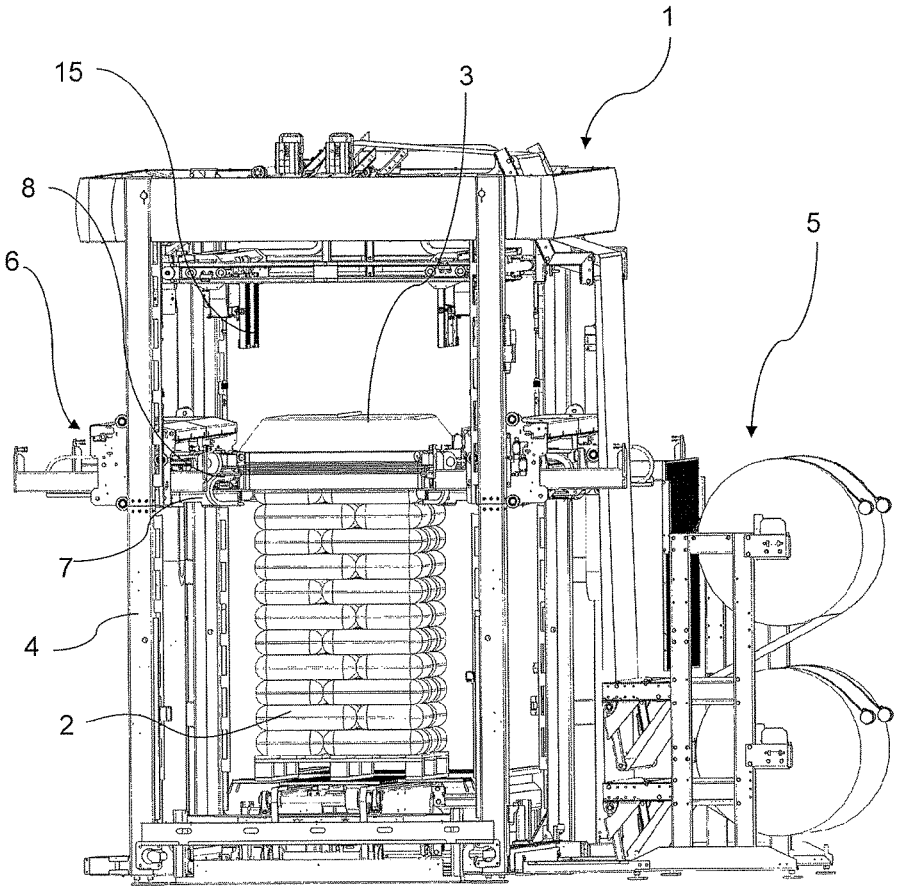
FIG. 1 shows a perspective view of a stretch hood system of the type in question according to the prior art.

In the present illustrated embodiment, the stretch hood system 1 has a reserve of tubular film in the form of a reel of the tubular film. The tubular film portion 3 is therefore only generated in the stretch hood system 1. However, it is conceivable, and also within the scope of the present disclosure, that tubular film portions are used that have already been cut to length in advance.

To make available the required tubular film portion 3, the stretch hood system 1 has a film supply device 5. The latter is arranged in the upper area of a machine frame 4 of the stretch hood system 1. A drawing-over device 6 and a reefing device 8 are arranged inside the machine frame 4.

Figure 2A:
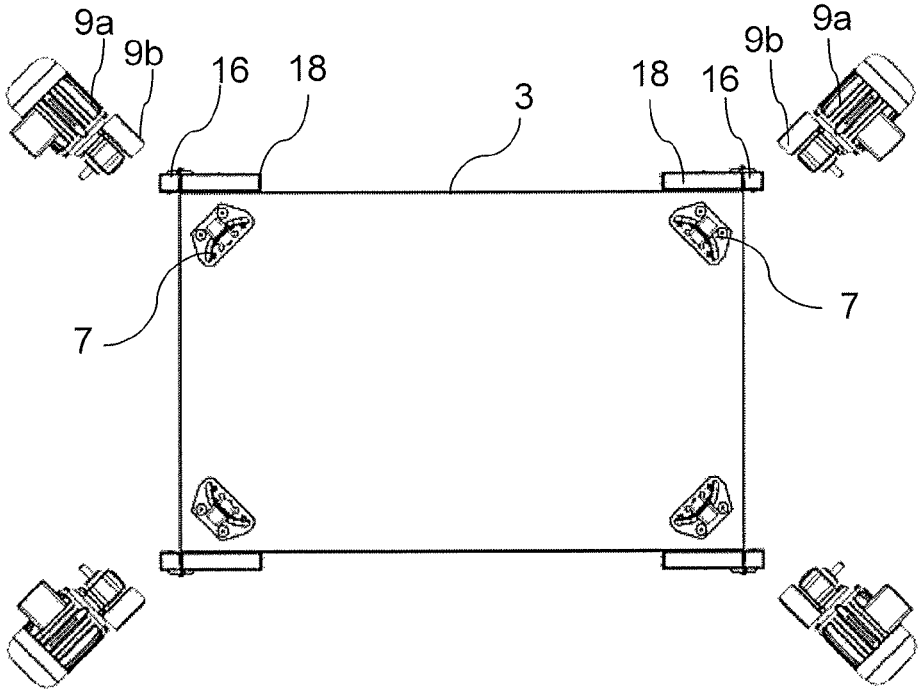
FIGS. 2*a* to 2*e* show successive steps of a method section of a packaging method of the type in question using the stretch hood system shown in FIG. 1; (a) inserting the reefing fingers into the tubular film portion; (b) release of the tubular film portion by the tubular-film-opening device; (c) moving the suction boxes away from the tubular film portion; (d) moving the reefing fingers to the tubular film portion; and (e) moving the reefing drives to the reefing fingers.

As can be seen in FIGS. 1 and 2*a*, the stretch hood system 1 has a tube-opening device 15 with four suction boxes 18 at which holding devices 16 are mounted. Moreover, the reefing device 8 has four reefing drives 9*a* to reef the tubular film portion 3 onto four reefing fingers 7 of the drawing-over device 6. In addition to the cited components of the stretch hood system 1, the latter has other sub-components (not shown), for example a cutting device, welding device or film delivery device.

FIGS. 2*a* to 2*e* show successive method steps of a packaging method of the type in question from the prior art, in which method the tubular film portion 3, with the aid of a stretch hood system 1 shown in FIG. 1, is drawn over the article 2 that is to be packaged. The figures show the method section from the insertion of the reefing fingers 7 into the tubular film portion 3 to the reefing of the tubular film portion 3 onto the reefing fingers 7. The figures are simplified in the sense that the stretch hood system 1 is viewed from above and not all components of the stretch hood system 1 are depicted.

Firstly, a certain portion of the tubular film in the form of the tubular film portion 3 is driven downward by the film supply device 5 and made available. It is then opened with the aid of the tube-opening device 15. For this purpose, the four suction boxes 18 of the tube-opening device 15 move toward the tubular film portion 3 which is hanging down loosely but is still folded together, so as to spread the tubular film portion 3 slightly apart by way of an underpressure. The tubular film portion 3 is then clamped by the holding devices 16 and thereby additionally secured. The suction boxes 18 then move apart and open the tubular film portion 3.

As is shown in FIG. 2*a*, the reefing fingers 7 thereafter move from below into the tubular film portion 3, which is held in position by the tube-opening device 15. The tubular film portion 3 has an almost rectangular cross section, since it is kept clamped at the four outer corners by the respective holding devices 16 of the suction boxes 18. The reefing fingers 7, during insertion, maintain a sufficient distance from the tubular film portion 3 in order not to damage the latter. At the respective four corners, the reefing drives 9*a* are positioned outside the tubular film portion 3 with a sufficient distance from the tubular film portion 3. The suction boxes 18 of the tube-opening device 15 are each located between the reefing fingers 7 and the reefing drives 9*a*. It is therefore impossible for the reefing drives 9*a* to be moved too early to the reefing fingers 7.

Figure 2B:
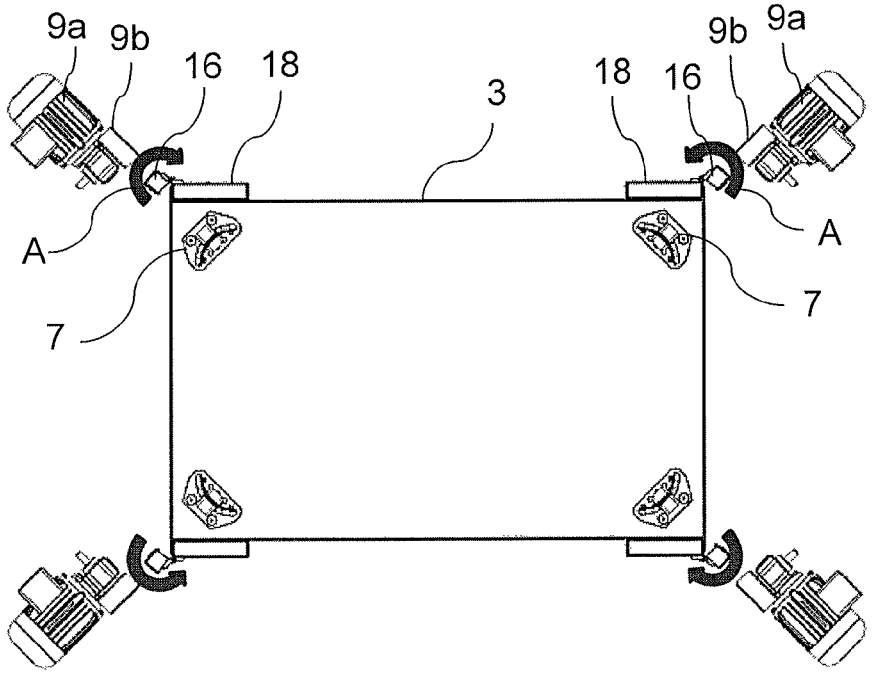

After the reefing fingers 7 have been inserted in the tubular film portion 3, the tubular film portion 3 is released by the holding devices 16, as is indicated by the arrows A in FIG. 2*b*. The position of the reefing fingers 7 and of the reefing drives 9*a* remains unchanged.

Figure 2C:
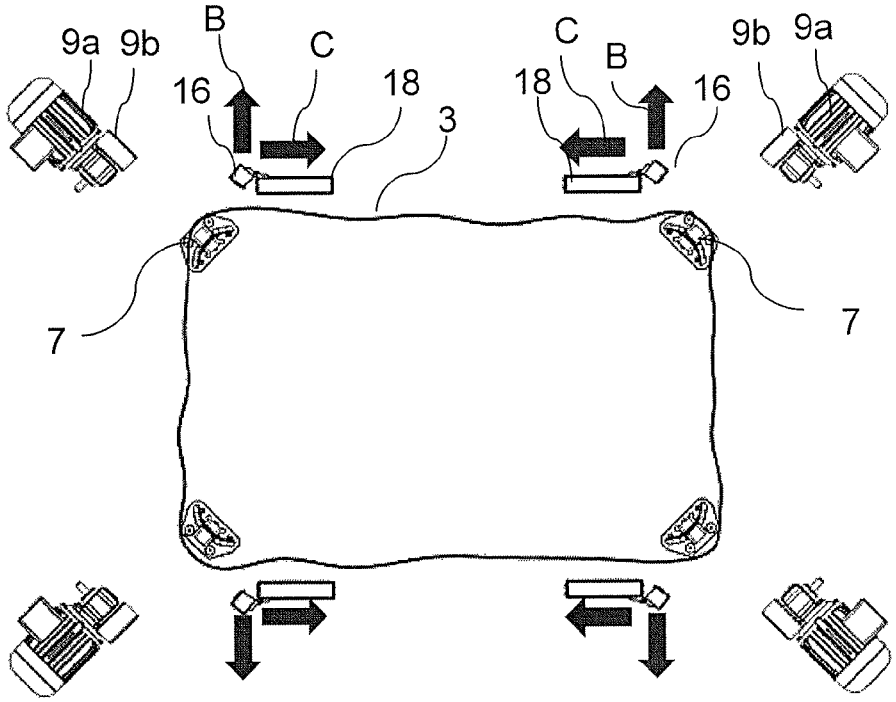

Thereafter, as is indicated by the arrows B and C in FIG. 2*c*, the suction boxes 18 move away from the tubular film portion 3. In doing so, two respective suction boxes 18 on one side of the tubular film portion 3 move horizontally toward each other (arrows C) and outward (arrows B) to free the space between the reefing fingers 7 and the reefing drives 9*a*. This space is later needed to enable the reefing drives 9*a* to move to the reefing fingers 7. In this method step, the tubular film portion 3 is held only loosely by the reefing fingers 7. In this way, the tubular film portion 3 loses much stability, since it is no longer held in position by the suction boxes 18 with their holding devices 16.

Figure 2D:
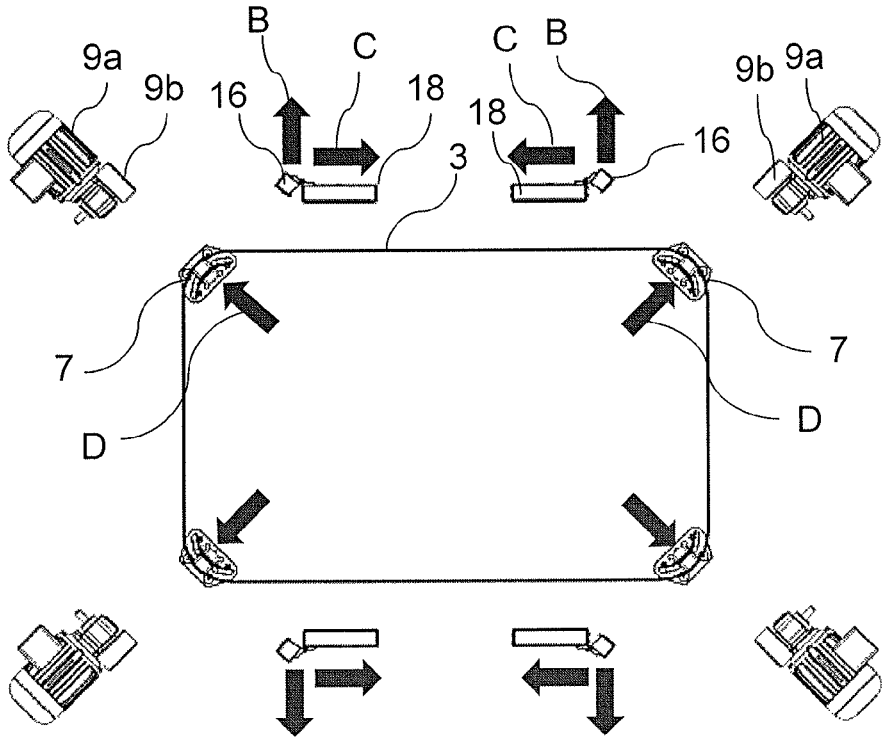

As is indicated by the arrows D in FIG. 2*d*, the reefing fingers 7 thereafter move to a reefing position, while the suction boxes 18 move farther away from the tubular film portion 3. In the reefing position, the tubular film portion 3 is extended with slight tensioning by the four reefing fingers 7. For this purpose, the four reefing fingers 7 move in the direction of the four corners of the tubular film portion 3. It is thus now possible to reef the tubular film portion 3 onto the reefing fingers 7.

Once the tubular film portion 3 bears on the reefing fingers 7, the reefing drives 9*a* of the reefing device 8 move to the reefing fingers 7 and begin reefing the tubular film portion 3 onto the reefing fingers 7. This method step is indicated by the arrows E in FIG. 2*e*. In this connection, the reefing drives 9*a* drive the reefing rollers 9*b*. In addition, the suction boxes 18 of the tube-opening device 15 move farther away from the tubular film portion 3.

The reefing is temporarily interrupted to cut off the tubular film portion 3 and weld it in the upper area of the machine frame 4 with the aid of a welding device. Thereafter, the tubular film portion 3 reefed onto the reefing fingers 7 can be drawn over the article 2 by the drawing-over device 6. For this purpose, the reefing fingers 7 of the drawing-over device 6 first of all move apart from each other again, as a result of which the tubular film portion 3 is further extended. The drawing-over device 6 moves downward and draws the film over the article 2 inside the machine frame 4. The tubular film portion 3 is unreefed again from the reefing fingers 7.

Figure 3:
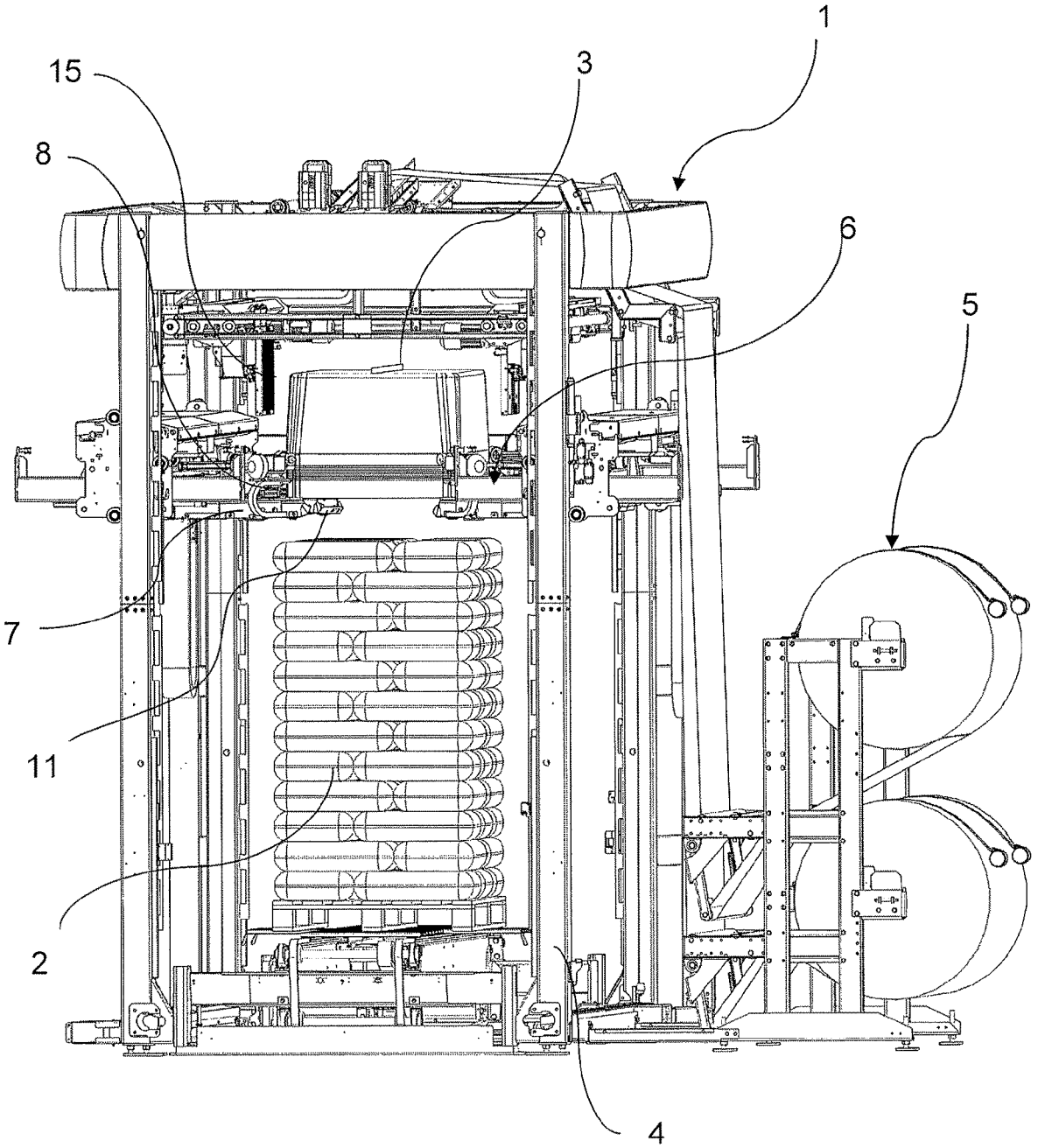
FIG. 3 shows a perspective view of a first illustrative embodiment of a stretch hood system according to the present disclosure.

A stretch hood system 1 in a first illustrative embodiment according to the present disclosure is described below before a discussion of the packaging method according to the present disclosure. FIG. 3 shows a perspective view of this stretch hood system 1. Components corresponding to those of the stretch hood system in FIG. 1 are provided here with the same reference signs. The stretch hood system 1 of FIG. 3 differs from the prior art in that here an inflating device 11 is additionally arranged inside the reefing fingers 7. It is thereby possible to at least partially inflate the tubular film portion 3.

FIGS. 4*a* to 4*e* show successive steps, of the method section shown in FIGS. 2*a* to 2*e*, of a packaging method in a first illustrative embodiment according to the present disclosure, using the stretch hood system 1 shown in FIG. 3. The simplified views and individual steps correspond to those of the steps of FIGS. 2*a* to 2*e*, with the difference that the tubular film portion 3 is at least partially inflated by the inflating device 11 during these method steps. If possible, it is inflated to such a degree that any folds in the tubular film portion 3 are already smoothed out by the inflation.

Figure 4A:
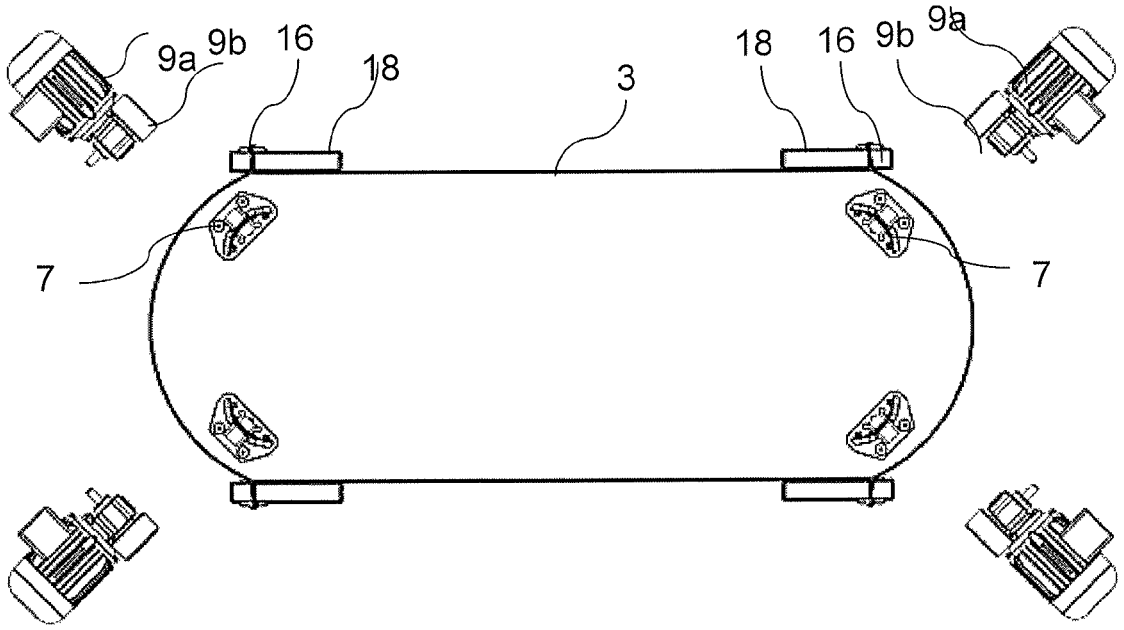
FIGS. 4*a* to 4*e* show successive steps, of the method section shown in FIGS. 2*a* to 2*e*, of a packaging method according to the present disclosure in a first illustrative embodiment using the stretch hood system shown in FIG. 3: (a) inserting the reefing fingers into the tubular film portion; (b) release of the tubular film portion by the tubular-film-opening device; (c) moving the suction boxes away from the tubular film portion; (d) moving the reefing fingers to the tubular film portion; and (e) moving the reefing drives to the reefing fingers.

Firstly, the tubular film portion 3 is made available and opened in the manner known from the prior art. However, as is shown in FIG. 4*a*, during the insertion of the reefing fingers 7 into the tubular film portion 3, the latter is inflated by way of the inflating device 11. In this way, a corresponding width of the opening of the tubular film portion 3 is generated and the reefing fingers 7 can be inserted farther than hitherto into the fold-free tubular film portion 3. The previously rectangular cross section of the tubular film portion 3 is stabilized in terms of its shape by the inflation and is extended laterally circularly at least at the front faces. It is thereby possible that the suction boxes 18 and holding devices 16 of the tube-opening device 15 can grip the tubular film portion 3 farther inward than previously in the prior art. This creates space for the reefing fingers 7, so as to be able to insert them directly into the tubular film portion 3. The suction boxes 18 are thus no longer located between the reefing drives 9*a* and the reefing fingers 7 to fix the outer corners of the tubular film portion 3. Damage to the tubular film portion 3 by the reefing fingers 7 is thus avoided by the inflation, while at the same time there is already sufficient space to be able to move the reefing drives 9*a* to the reefing fingers 7 much earlier.

Figure 4B:
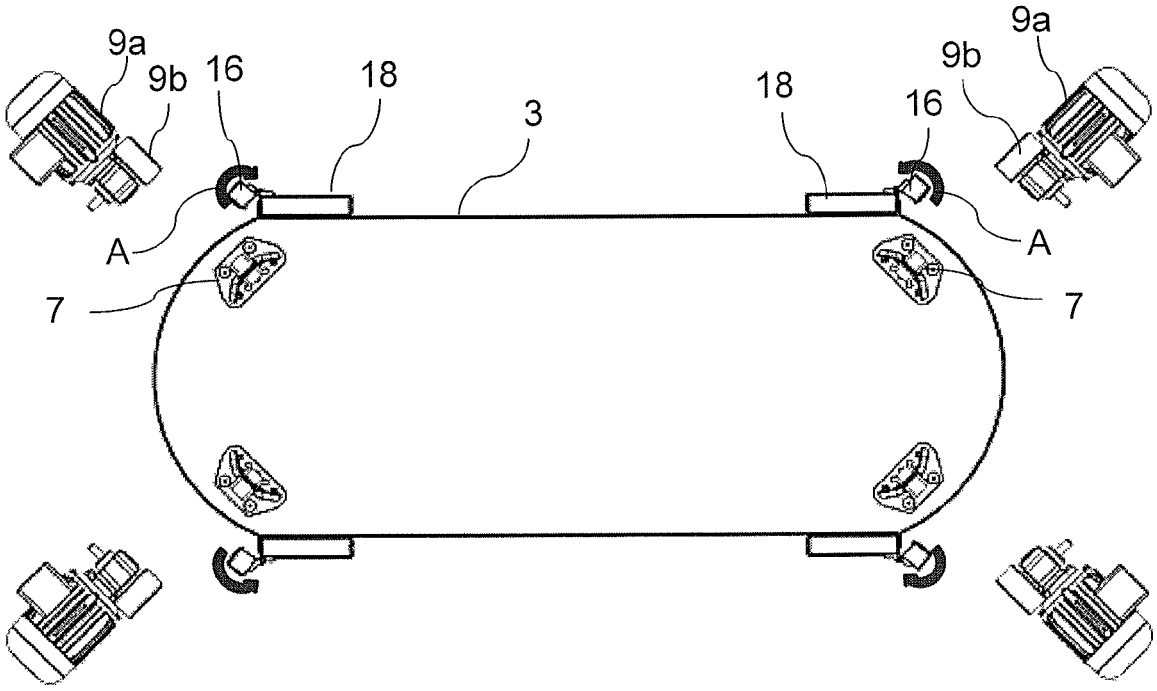

The arrows A in FIG. 4*b* indicate how the holding devices 16 of the tube-opening device 15 then release the tubular film portion 3 again. The tubular film portion 3 is further inflated and stabilized by the inflating device 11.

Figure 4C:
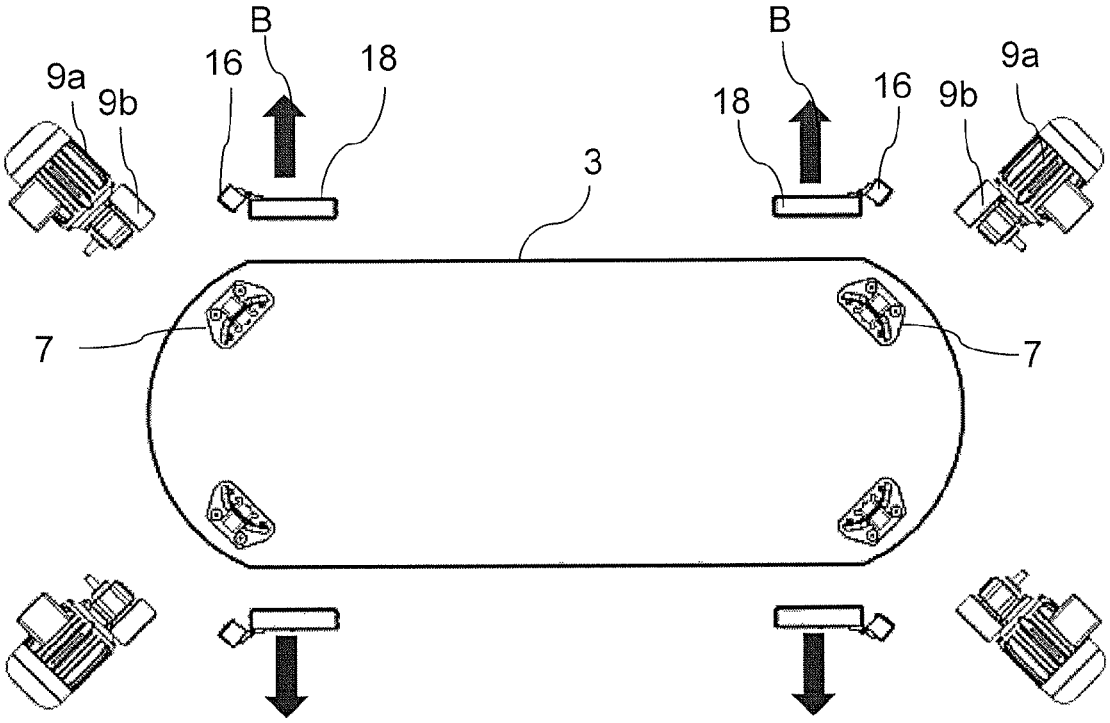

The suction boxes 18 of the tube-opening device 15 are then moved away from the tubular film portion 3, as is indicated by the arrows B in FIG. 4*c*. In contrast to FIG. 2*c*, it is not necessary here that two respective suction boxes 18 on one side move toward each other. The area between reefing drive 9*a* and the reefing finger 7 is not in fact blocked by the suction boxes 18. Thus, these have to move away only in the horizontal direction. Moreover, as a result of the inflation still carried out, the tubular film portion 3 maintains its stable and as far as possible smoothed shape, which is not the case in FIG. 2*c*.

Figure 4D:
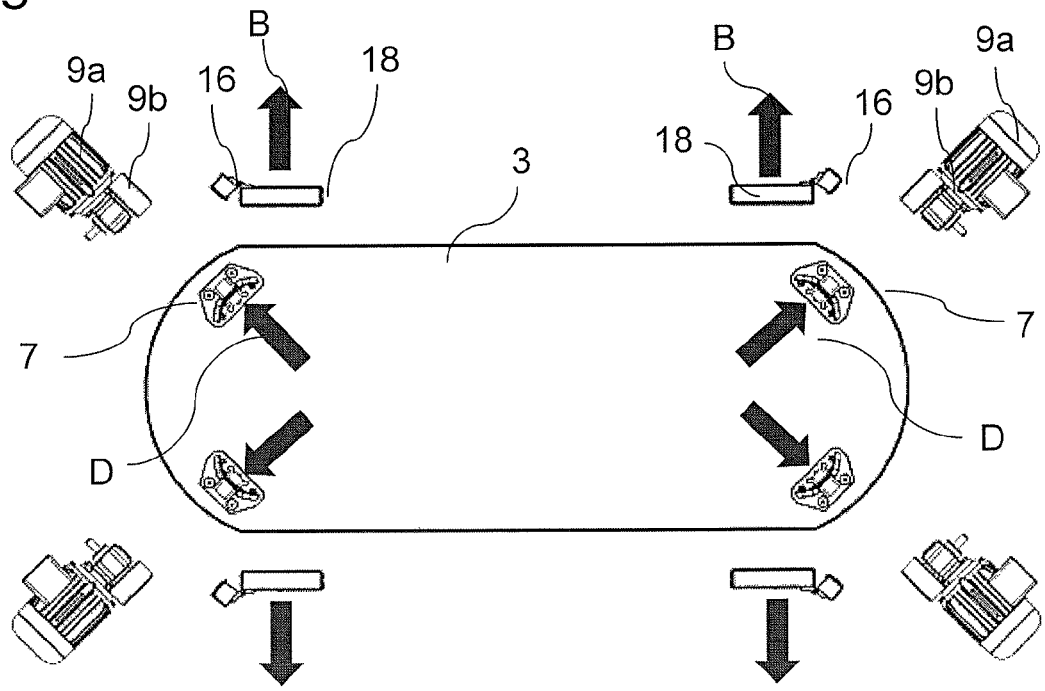

As is shown by the arrows D in FIG. 4*d*, in the next step the reefing fingers 7 move to the tubular film portion 3. The tubular film portion 3 comes to bear on the reefing fingers 7 (reefing position). It can be seen clearly here that, on account of the lateral extension of the tubular film portion 3, the reefing fingers 7 are able to receive the tubular film portion 3 in a way which, compared to previously, is gentler on the material. Since the tubular film portion 3 no longer has strongly pronounced corners resulting from the opening procedure, the load to which the tubular film portion 3 is subject is reduced. Moreover, the reefing fingers 7 bear smoothly on the film. This reduces the risk of superposed folds, which place a considerable load on the film during the extension. Moreover, by virtue of the stable shape of the tubular film portion 3, the suction boxes 18 are able to move away simultaneously from the tubular film portion 3 (arrows B).

Figure 2E:
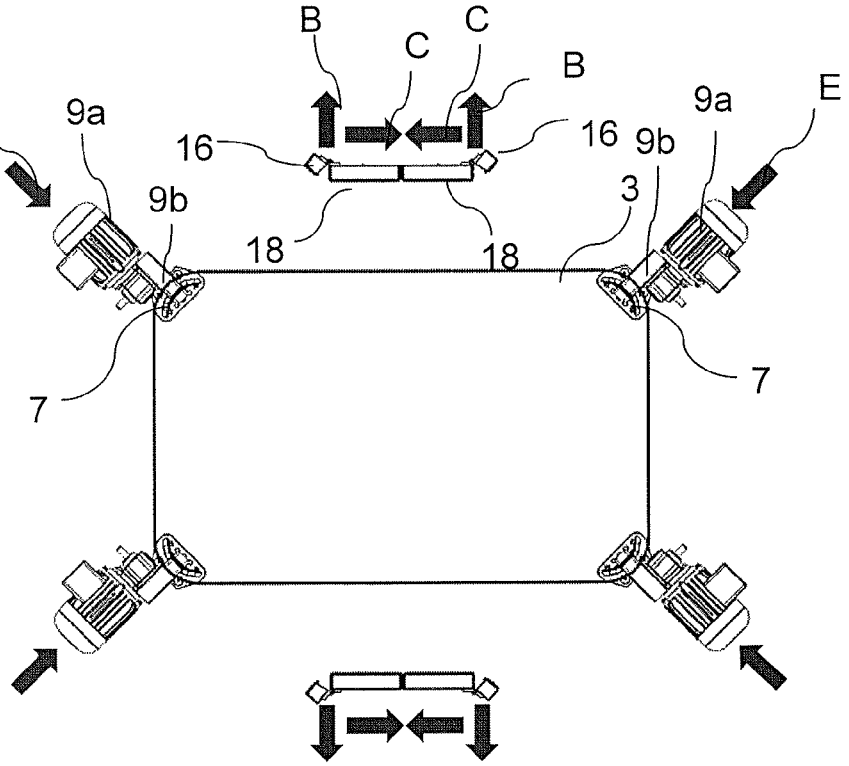
Figure 4E:
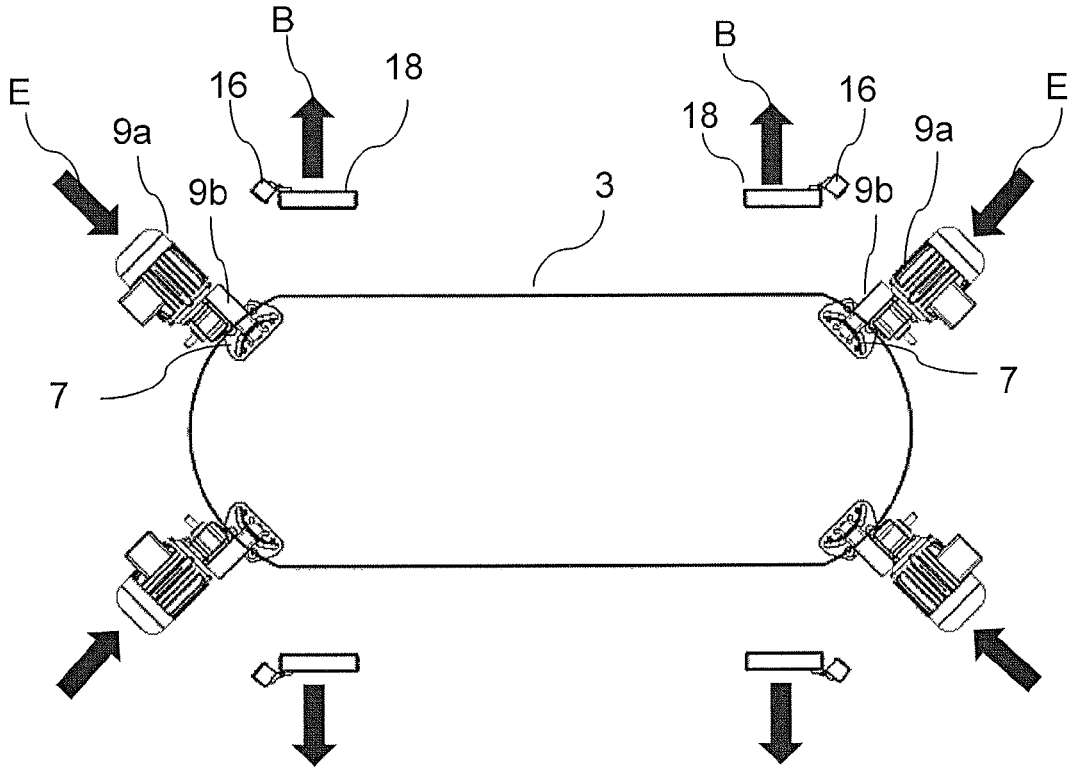

As has already been indicated in FIG. 2*e*, the arrows E in FIG. 4*e* show how the reefing drives 9*a* move to the reefing fingers 7, in order thereafter to reef the tubular film portion 3 onto the reefing fingers 7.

The tubular film portion 3 is also inflated during the reefing. This has the effect that the tubular film portion 3 can be reefed onto the reefing fingers 7 in a way that is particularly gentle on material. An air cushion caused by the inflation develops between the tubular film portion 3 and the reefing fingers 7, and the tubular film portion 3 slides on this air cushion during the reefing. At the same time, the weld seam of the tubular film portion 3 is cooled, which more quickly increases the strength.

The subsequent method steps up to the covering of the article 2 correspond to those from the prior art. By way of the measures described, this method step is much less prone to interference than has previously been the case. Moreover, on account of the much more precise folding during the reefing, damage to the tubular film 3 during more rapid unreefing can be avoided. The packaging method according to the present disclosure is therefore quicker, while permitting a higher quality of packaging. Overall, a particularly efficient packaging method is thus made available.

Figure 5:
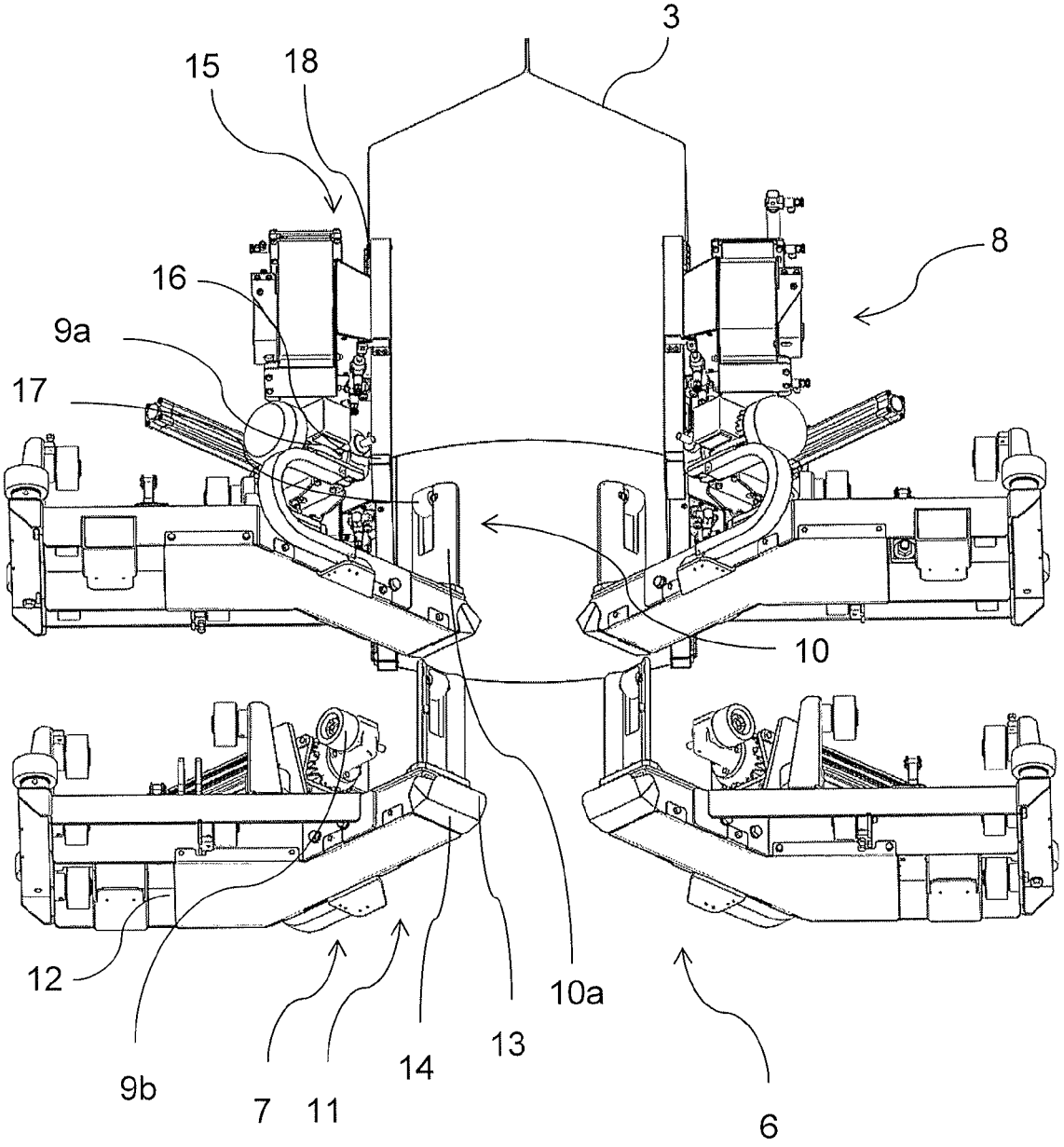
FIG. 5 shows a perspective view of a detail of the stretch hood system shown in FIG. 3, during the method step in FIG. 4*a;*

The stretch hood system 1, according to the present disclosure, of FIG. 3 is once again described in detail below during various method steps. FIG. 5 therefore shows a perspective view of a detail of the stretch hood system 1 obliquely from below upward, during the method step in FIG. 4*a*. For reasons of clarity, not all the components are shown here. The same components are provided with the same reference signs.

The reefing device 8 of the stretch hood system 1 is in particular shown in more detail. In the present illustrative embodiment, the reefing device 8 is arranged at the four reefing fingers 7 of the drawing-over device 6. The reefing fingers 7 are adjustable in terms of their position both horizontally and also vertically. Moreover, each reefing finger 7 is individually controllable, such that a symmetrical or simultaneous movement of the individual reefing fingers 7 is also possible.

A reefing drive 9*a* is arranged on each of the horizontal portions of the reefing fingers 7. With the aid of the reefing drives 9*a*, it is possible to reef the required length of the tubular film portion 3 onto the reefing fingers 7. The reefing drives 9*a* are for this purpose displaceable along the reefing fingers 7, such that, after the reefing fingers 7 each bear with a reefing-on surface 10 at the tubular film portion 3, the reefing drives 9*a* can each move from outside toward the tubular film portion 3 and, by way of a conveying mechanism (in the present case a reefing roller 9*b*), can begin the reefing procedure.

The inflating device 11 is arranged here inside the reefing fingers 7. In the example shown here, constituent parts of the inflating device 11 include an air inlet 12, behind which a fan sits, from which the suctioned air is guided through a channel inside the respective reefing finger 7 to the outlet opening 13 at the horizontal end of the reefing finger 7. Moreover, a selectively closable closure element 14, designed here as a flap, is arranged at the horizontal end of the reefing finger 7, which closure element 14 closes the outlet opening 13 as desired or opens it to a certain degree. With the aid of the closure element 14, it is possible for the resulting air stream, generated by the inflating device 11, to be deflected in the direction of the interior of the tubular film portion 3.

By way of an adjusting device, it is possible to throttle and adapt the volumetric flow that is blown into the tubular film portion 3. For this purpose, the adjusting device has a throttle element, which is designed as a flap. In this illustrative embodiment, the throttle element thus corresponds to the closure element 14. The volumetric flow can thus be adjusted according to the material property and the film thickness. In this way, damage and tears in the tubular film portion 3 can be avoided, even when different film thicknesses are used.

The tube-opening device 15 here includes four individual suction boxes 18, which are horizontally and vertically movable independently of the drawing-over device 6. Thus, the suction boxes 18 can be placed individually onto the still unopened tubular film portion 3 and draw the latter apart. In this connection, the suction boxes 18 accordingly approach the tubular film portion 3 symmetrically from opposite sides and, by generating an underpressure, achieve a bearing of the tubular film of the tubular film portion 3 on the respective suction box 18. The suction boxes 18 then move apart again and thereby open the tubular film portion 3.

The holding devices 16 at the suction boxes 18 are each designed as a flap mechanism. On account of the film being stabilized by the inflation during opening, the use of the holding devices 16 is optional and thus no longer absolutely necessary for performing the packaging method according to the present disclosure.

As FIG. 4*a* has already shown, FIG. 5 once again illustrates how the inflation of the tubular film portion 3 stabilizes the latter and extends it laterally. The reefing fingers 7 can thus be safely inserted from below into the tubular film portion 3 without causing damage to the latter.

Figure 6:
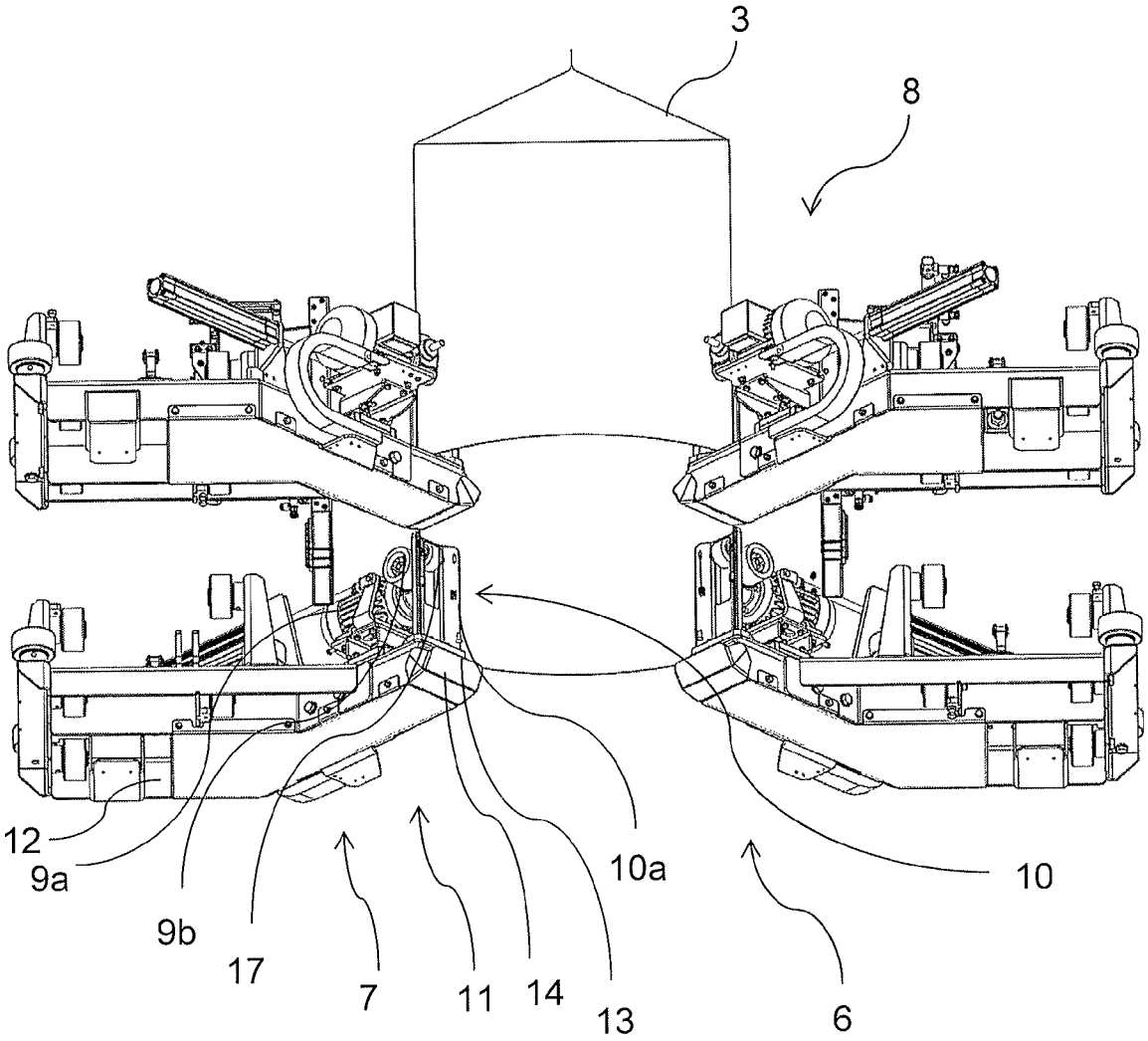
FIG. 6 shows a perspective view of a detail of the stretch hood system shown in FIG. 3, during the method step in FIG. 4*e;*

FIG. 6 shows a further perspective view according to FIG. 5, during the method step in FIG. 4*e*. The reefing fingers 7 are already inserted in the tubular film portion 3 and bear on the latter (reefing position). The reefing drives 9*a* move to the reefing fingers 7 to reef the tubular film portion 3 onto the reefing fingers 7. The suction boxes 18 of the tube-opening device 15 have already moved away and are therefore no longer depicted. As a result of the inflation, the tubular film portion 3 is in a much smoother state than before, and therefore complications can be avoided during reefing and unreefing.

Figure 7:
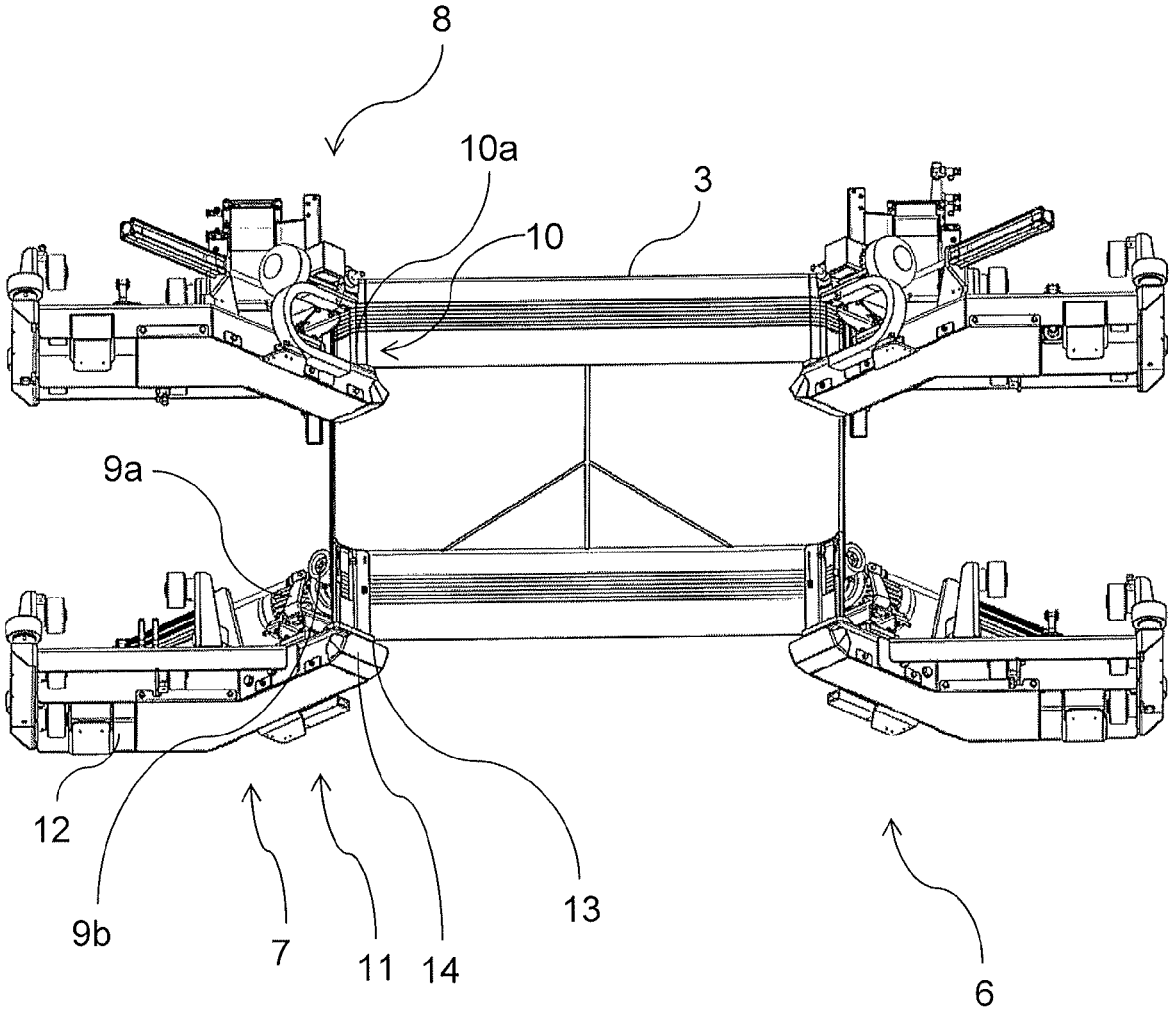
FIG. 7 shows a perspective view of a detail of the stretch hood system shown in FIG. 3, during the reefing.

FIG. 7 shows a further perspective view during reefing. The closure elements 14 of the inflating device 11 at the reefing fingers 7 are opened to inflate the tubular film portion 3. In this way, the tubular film portion 3 can be reefed onto the reefing-on surfaces 10 of the reefing fingers 7 uniformly and more or less without folds. For this purpose, the reefing drives 9*a* are moved to the reefing fingers 7 to permit reefing with the aid of the conveying mechanism.

Figure 8:
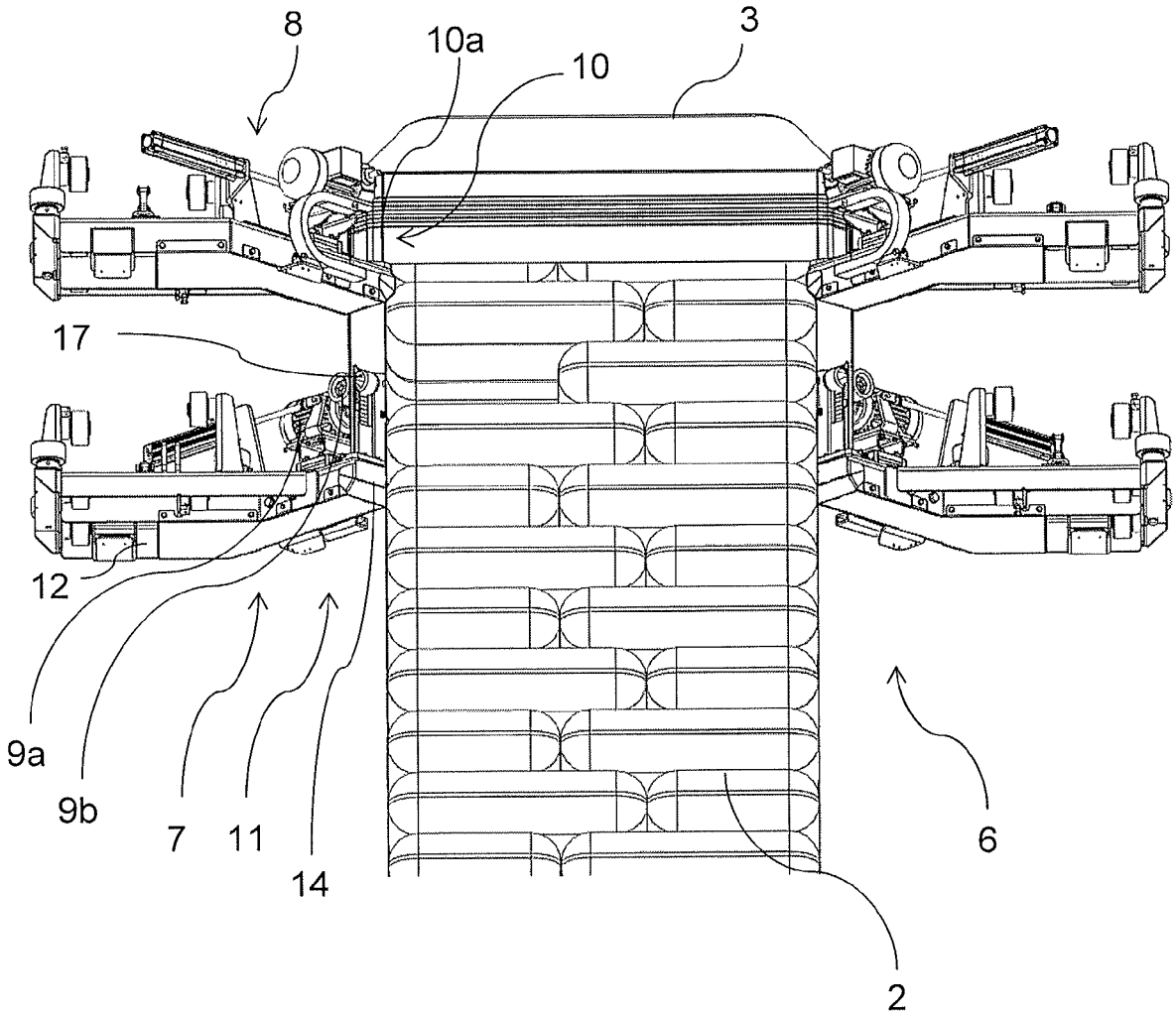
FIG. 8 shows a perspective view of a detail of the stretch hood system shown in FIG. 3, during the unreefing.

FIG. 8 once again shows the perspective view during unreefing. After the unreefing position has been adopted, the drawing-over device 6 moves downward to cover the article 2 with the tubular film portion 3. The tubular film portion 3 is unreefed again from the reefing fingers 7 by way of the reefing drives 9*a*. The reefing drives 9*a* are thus still moved up to the reefing fingers 7 to assist the drawing-off of the tubular film portion 3 with the aid of the reefing rollers 9*b*. The closure elements 14 of the inflating device 11 remain closed, since the tubular film portion 3 meanwhile is not inflated in the variant shown here.

Figure 9:
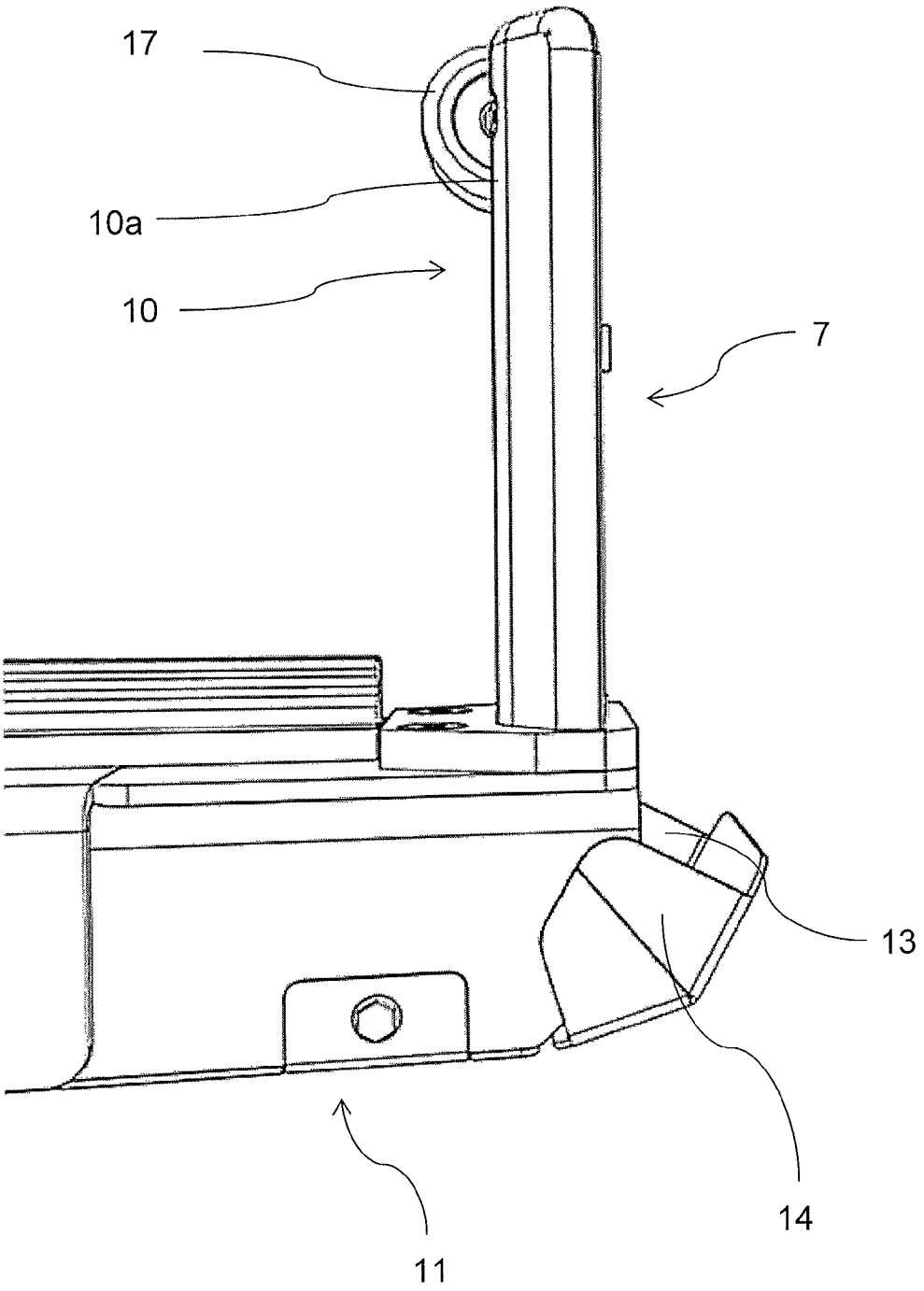
FIG. 9 shows a perspective view of a reefing finger of the stretch hood system shown in FIG. 3.

FIG. 9 shows in more detail the end of the horizontal portion of the reefing finger 7 and also the vertical portion of the reefing finger 7. The closure element 14 is opened in this state to lead air accordingly from the outlet opening 13 in the direction of the tubular film portion 3. By virtue of the arrangement of the closure element 14, it is now possible to guide the air stream vertically upward in the direction of the tubular film portion 3. Thus, the inflating device 11 extends into each of the four reefing fingers 7 to ensure, by inflation, a suitable stability of the tubular film portion 3 precisely at these locations. This therefore permits safe insertion of the reefing fingers 7 into the tubular film portion 3 and reduces the stress on the material during reefing and/or unreefing.

In the illustrative embodiment shown here, the closure element 14 is arranged on the side of the reefing finger 7 opposite the reefing-on surface 10. The reefing-on surface 10 includes two individual surfaces 10*a* which are slightly angled and are provided with wear protection strips. A guide roller 17 is arranged between the two subsidiary surfaces of the reefing-on surface 10 at the end of the vertical portion of the reefing finger 7, such that the tubular film portion 3 can be reefed uniformly and without damage by the terminating edges of the vertical portion of the reefing finger 7.

The horizontal portion of the reefing finger 7 shown in FIG. 9 moreover has a pressure-increasing mechanism. It is thus possible to ensure that air is suitably aspirated through the air inlet 12 and can emerge with suitable pressure through the outlet opening 13. Since the pressure-increasing mechanism is arranged inside the horizontal portion of the reefing finger 7, it is not shown explicitly in FIG. 3.

FIGS. 10*a* to 10*d* shows successive steps of a packaging method according to the present disclosure in a second illustrative embodiment, using the stretch hood system 1 shown in FIG. 3. The method section corresponds to that of the first illustrative embodiment in FIGS. 4*a* to -4*e*, this method section being reduced to four steps. All of the aforementioned advantages afforded by the inflation of the tubular film portion 3 in FIGS. 4*a* to 4*e* apply accordingly to this illustrative embodiment. Identical components are provided with the same reference signs.

Figure 10A:
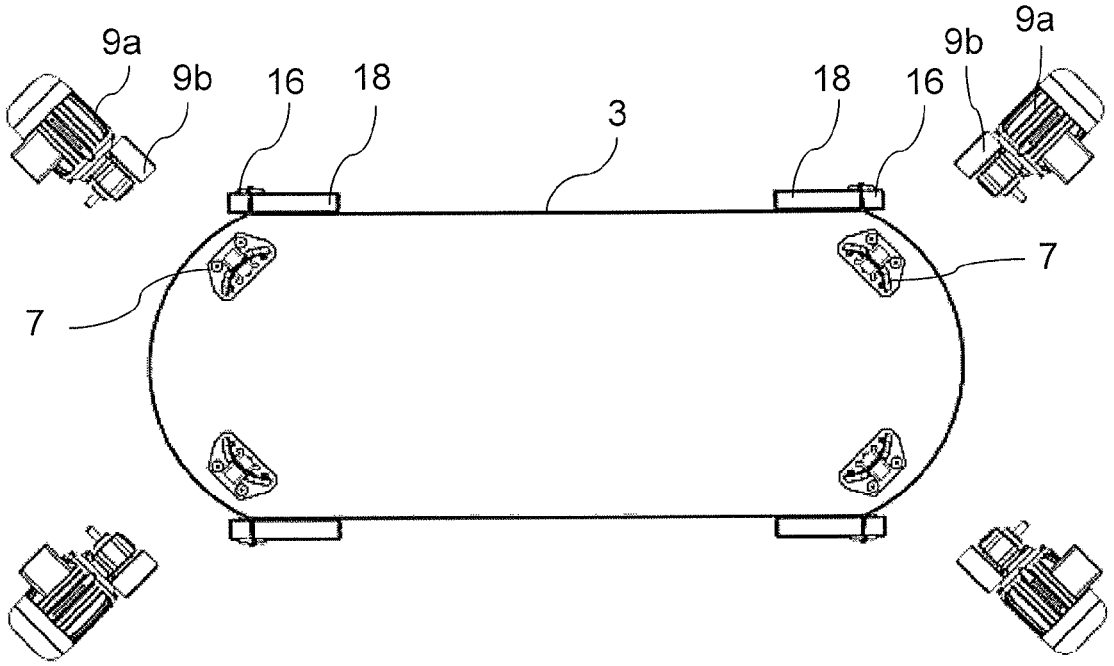
FIGS. 10*a* to 10*d* show successive steps, of the method section shown in FIGS. 4*a* to 4*e*, of a packaging method according to the present disclosure in a second illustrative embodiment using the stretch hood system shown in FIG. 3: (a) inserting the reefing fingers into the tubular film portion; (b) release of the tubular film portion by the tubular-film-opening device; (c) moving the reefing drives to the reefing fingers; and (d) moving the suction boxes away from the tubular film portion.
Figure 10B:
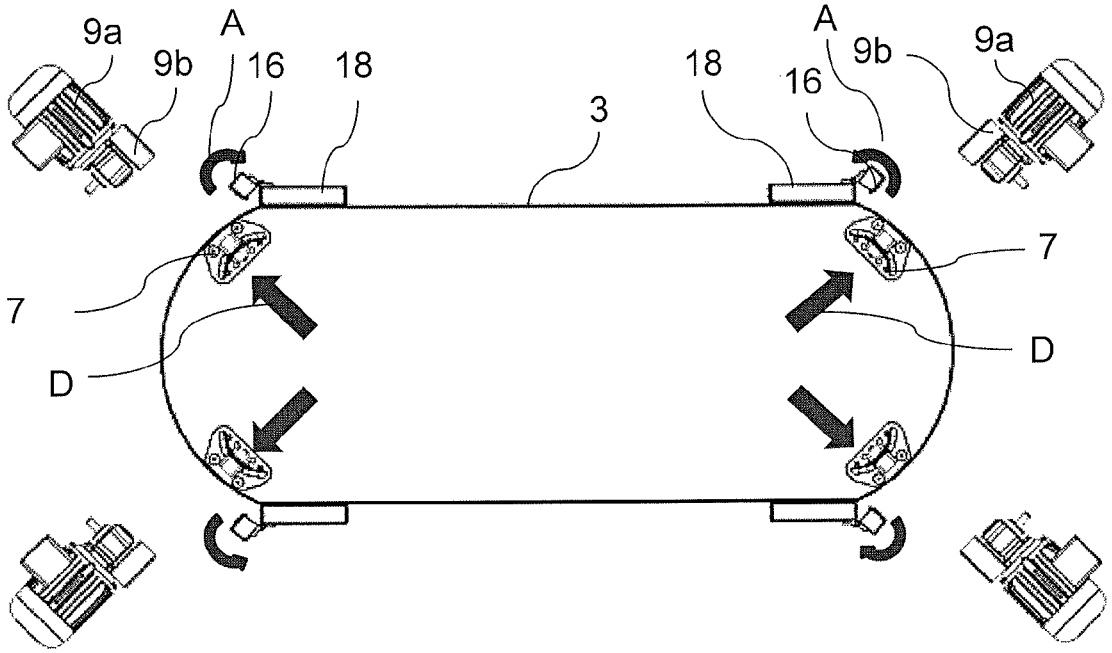

The insertion of the reefing fingers 7 into the tubular film portion 3 as shown in FIG. 10*a* corresponds to the first illustrative embodiment in FIG. 4*a*. As is shown in FIG. 10*b*, the holding devices 16 then free the tubular film portion 3 again (arrows A) in accordance with FIG. 4*b*. However, in contrast to FIG. 4*b*, the reefing fingers 7 already move at the same time to the reefing position (arrows D) to speed up the method.

Figure 10C:
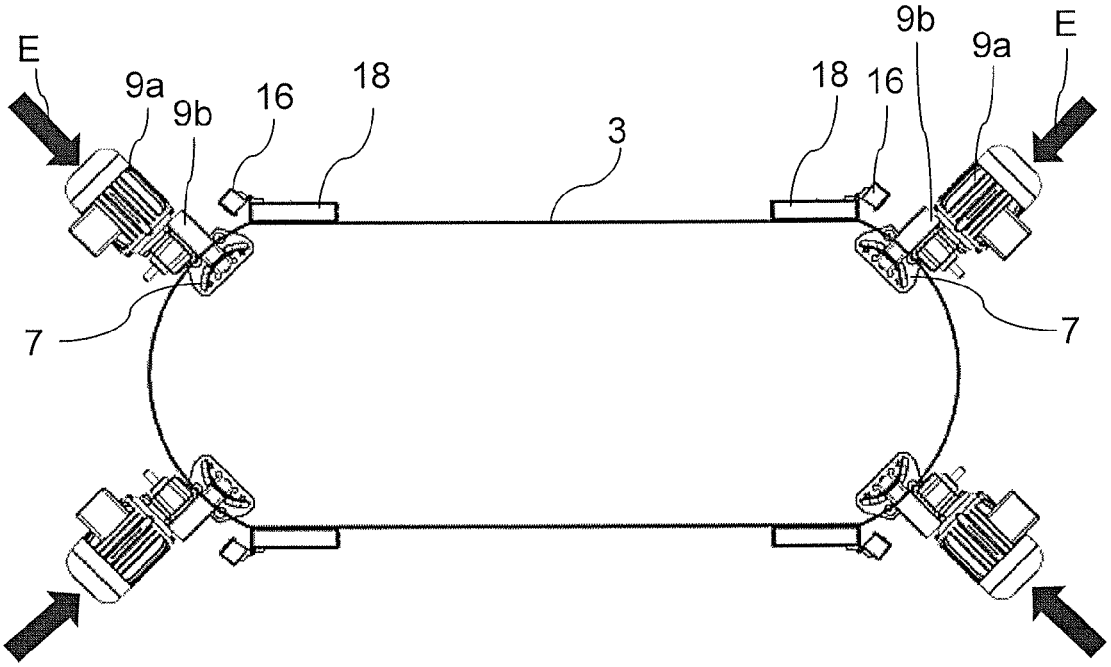

As is shown in FIG. 10*c*, the reefing drives 9*a* then move to the reefing fingers 7 (arrows E) to reef the tubular film portion 3 onto the reefing fingers 7. The suction boxes 18 of the tube-opening device 15 are still located at the tubular film portion 3 but do not block the space between the reefing fingers 7 and the reefing drives 9*a*, as is known from the prior art in FIG. 2*b*.

Figure 10D:
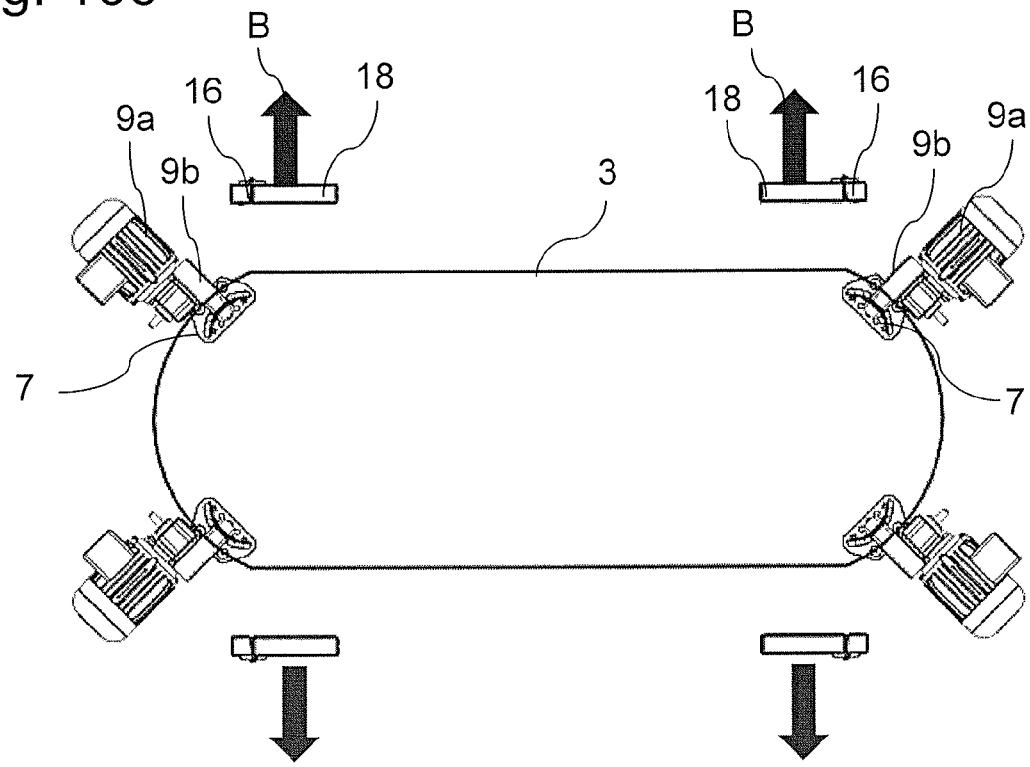

FIG. 10*d* shows the last step of the method section. While the suction boxes 18 of the tube-opening device 15 move away in the horizontal direction (arrows B), perpendicularly from the tubular film portion, the reefing drives 9*a* can already begin to reef the tubular film portion 3 onto the reefing fingers 7. By virtue of the fact that the reefing fingers 7 move earlier to the reefing position and the reefing drives 9*a* move earlier to the reefing fingers 7, the method sequence described above can thus be sped up.

Figure 11:
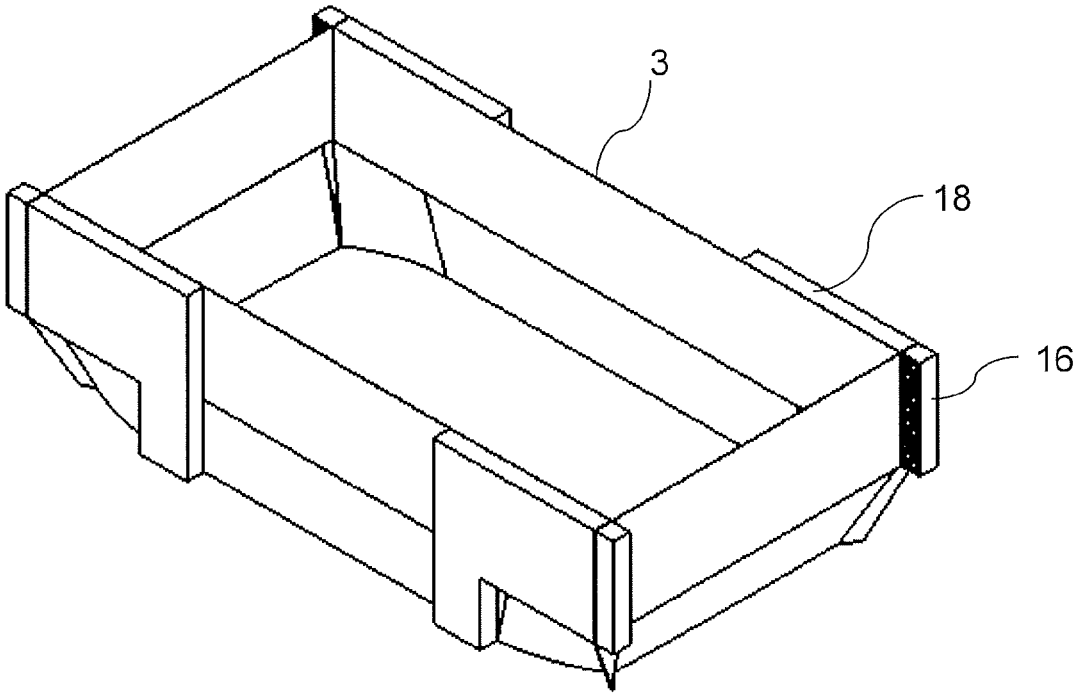
FIG. 11 shows a perspective view of a tubular film portion in the opening system of a stretch hood system according to the prior art.

FIG. 11 shows a tubular film portion 3 in the opening system of a conventional stretch hood system 1. For better insertion of the reefing fingers (not shown here), the holding devices 16 (here designed for example as suction boxes 18) are provided with a recess. In this way, the holding devices 16 have an L-shaped appearance. On account of this recess, however, the lower edge of the tubular film portion 3 curves in earlier than would be the case in holding devices having no such recess.

Figure 12:
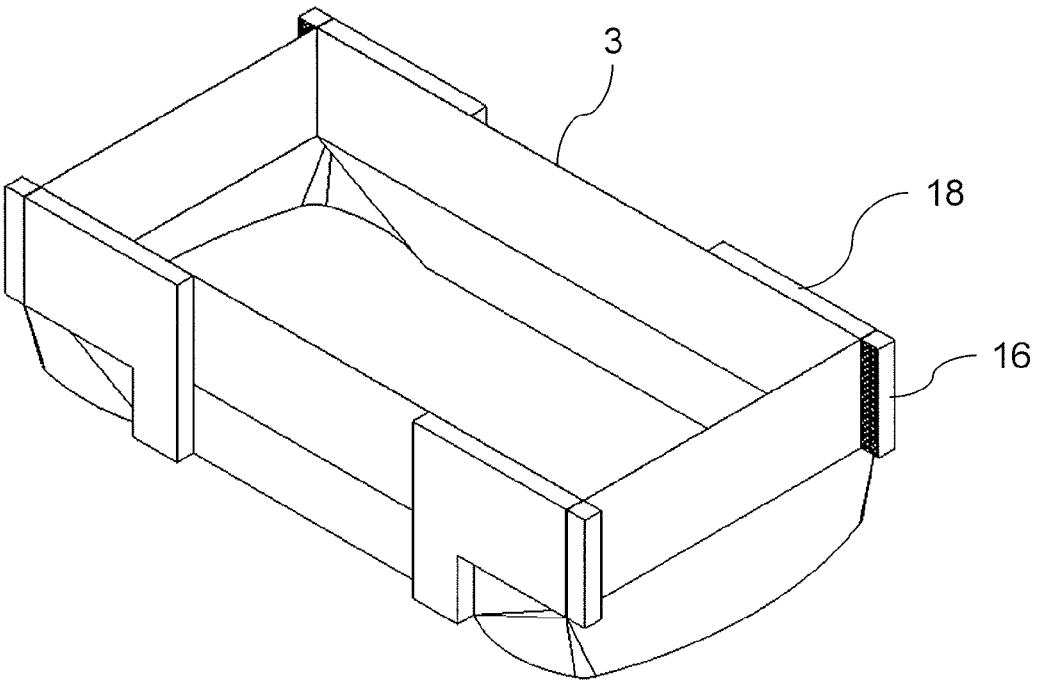
FIG. 12 shows a perspective view of a tubular film portion in the opening system of a stretch hood system according to one embodiment of the present disclosure.

As can be seen by comparison with the embodiment according to the present disclosure shown in FIG. 12, this disadvantage is compensated, in the method according to the present disclosure and in a device according to the present disclosure, by the inflation of the tubular film portion 3 during the opening procedure. Here, the open edge is extended and the tube stabilized by the inflation. It does not curve inward as in FIG. 11 but instead outward. In this way, the reefing fingers have more space during insertion and can be moved closer and more exactly to the tube.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A stretch-hood device for wrapping an article with a tubular film portion, the stretch-hood device comprising:

a tube-opening device configured to open the tubular film portion, the mbe-opening device including multiple suction boxes configured to engage and releasably retain part of the tubular film portion;

a drawing-over device separate from the tube-opening device and including two reefing fingers;

a reefing device separate from the tube-opening device and configured to reef the tubular film portion onto the reefing fingers and unreef the tubular film portion from the reefing fingers; and an inflating device configured to direct gas into an interior of the tubular film portion during the reefing, one of the reefing fingers including the inflating device.

2. The stretch-hood device of claim 1, wherein the inflating device is a first inflating device of a first one of the reefing fingers, and wherein a second of the reefing fingers includes a second inflating device.

3. The stretch-hood device of claim 1, wherein the inflating device comprises an outlet opening through which the gas is expelled from the inflating device.

4. The stretch-hood device of claim 3, wherein the inflating device further comprises a closure element configured to selectively close the outlet opening.

5. The stretch-hood device of claim 4, wherein the outlet opening is arranged on a side of the reefing finger opposite a reefing-on surface of the reefing finger.

6. The stretch-hood device of claim 1, wherein the suction boxes are movable relative to one another to open the tubular film portion.

7. The stretch-hood device of claim 1, wherein the inflating device comprises one of a tan and a compressed air source.

8. A method for wrapping an article with a tubular film portion, the method comprising:

opening, via a tube-opening device, the tubular film portion by engaging and releasably retaining part of the tubular film portion with multiple suction boxes and moving the suction boxes radially outwardly;

reefing, via a reefing device separate from the tube-opening device, the tubular film portion onto two reefing fingers of a drawing-over device separate from the tube-opening device;

while moving the drawing-over device relative to the article, unreefing, via the reefing device, the tubular film portion from the reefing fingers onto the article; and directing gas into in interior of the tubular film portion via an inflating device during the reefing, the inflating device being part of the reefing device.

9. The method of claim 8, wherein directing the gas into the interior of the tubular film portion causes the tubular film portion to inflate such that the tubular film portion is tau t at its open lower end.

10. The method of claim 8, further comprising welding, via a welding device, in upper end of the tubular film portion to close the upper end of the tubular film portion.

11. The method of claim 10, wherein directing the gas into the interior of the tubular film portion occurs during or after the welding.

12. The method of claim 8, further comprising inserting the reefing fingers into an open lower end of the tubular film portion while directing the gas into the interior of the tubular film portion and while the tube-opening device holds the tubular film portion.

13. The method of claim 8, further comprising changing a flow rate of the gas via an adjusting device.

* * * * *